US009494901B2

(12) United States Patent
Saito et al.

(10) Patent No.: US 9,494,901 B2
(45) Date of Patent: Nov. 15, 2016

(54) FIXING DEVICE AND IMAGE FORMING APPARATUS WITH A ROTATABLE LIGHT SHIELD

(71) Applicants: Kazuya Saito, Kanagawa (JP); Ryuuichi Mimbu, Kanagawa (JP); (Continued)

(72) Inventors: Kazuya Saito, Kanagawa (JP); Ryuuichi Mimbu, Kanagawa (JP); Toshihiko Shimokawa, Kanagawa (JP); Haruyuki Honda, Kanagawa (JP); Yoshiki Yamaguchi, Kanagawa (JP); Yasunori Ishigaya, Kanagawa (JP); Keitaro Shoji, Kanagawa (JP); (Continued)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/952,522

(22) Filed: Nov. 25, 2015

(65) Prior Publication Data

US 2016/0154350 A1 Jun. 2, 2016

(30) Foreign Application Priority Data

Dec. 1, 2014 (JP) ..... 2014-242984

(51) Int. Cl.
*G03G 15/20* (2006.01)

(52) U.S. Cl.
CPC ..... *G03G 15/2057* (2013.01)

(58) Field of Classification Search
CPC ..... G03G 15/2017
(Continued)

(56) References Cited

U.S. PATENT DOCUMENTS 7,348,524 B2 * 3/2008 Takematsu
7,437,113 B2 * 10/2008 Suzuki
(Continued)

FOREIGN PATENT DOCUMENTS

JP 2004-235001 8/2004
JP 2006267420 A * 10/2006
JP 2007-334205 12/2007

OTHER PUBLICATIONS

U.S. Appl. No. 14/790,297, filed Jul. 2, 2015.
(Continued)

*Primary Examiner* — Walter L Lindsay, Jr.
*Assistant Examiner* — Milton Gonzalez
(74) *Attorney, Agent, or Firm* — Duft Bornsen & Fettig LLP

(57) ABSTRACT

A fixing device includes a nip formation pad pressing against a pressure rotator via a fixing rotator to form a fixing nip between the fixing rotator and the pressure rotator. The nip formation pad includes a base and a first thermal conductor sandwiched between the base and the fixing rotator at the fixing nip and having a first thermal conductivity greater than a basic thermal conductivity of the base. A first heater and a second heater are disposed opposite an inner circumferential surface of the fixing rotator to heat the fixing rotator. A rotatable light shield moves to a shield position where the light shield is interposed between the second heater and the fixing rotator to shield the fixing rotator from the second heater. The second heater is disposed at a location where the light shield screens the second heater more readily than the first heater.

19 Claims, 16 Drawing Sheets

(71) Applicants: Toshihiko Shimokawa, Kanagawa (JP); Haruyuki Honda, Kanagawa (JP); Yoshiki Yamaguchi, Kanagawa (JP); Yasunori Ishigaya, Kanagawa (JP); Keitaro Shoji, Kanagawa (JP); Yutaka Ikebuchi, Kanagawa (JP); Yoshio Hattori, Kanagawa (JP)

(72) Inventors: Yutaka Ikebuchi, Kanagawa (JP); Yoshio Hattori, Kanagawa (JP)

(58) Field of Classification Search
USPC ..... 399/329, 334
See application file for complete search history.

(56) References Cited

U.S. PATENT DOCUMENTS

| | | | |
|---|---|---|---|
| 2007/0292175 | A1 | 12/2007 | Shinshi |
| 2010/0158587 | A1* | 6/2010 | Shin ..... 399/329 |
| 2012/0008971 | A1* | 1/2012 | Lee |
| 2014/0072355 | A1 | 3/2014 | Tamaki et al. |
| 2014/0079424 | A1 | 3/2014 | Ikebuchi et al. |
| 2014/0079453 | A1 | 3/2014 | Arai et al. |
| 2014/0079455 | A1 | 3/2014 | Seki et al. |
| 2014/0133879 | A1 | 5/2014 | Seshita et al. |
| 2014/0248072 | A1 | 9/2014 | Yoshinaga et al. |
| 2014/0270820 | A1 | 9/2014 | Saito et al. |
| 2014/0270831 | A1 | 9/2014 | Yoshinaga et al. |
| 2014/0270832 | A1 | 9/2014 | Saito et al. |
| 2014/0270833 | A1 | 9/2014 | Yuasa et al. |
| 2014/0270872 | A1 | 9/2014 | Tamaki et al. |
| 2014/0270875 | A1 | 9/2014 | Mimbu et al. |
| 2014/0341623 | A1 | 11/2014 | Arai et al. |
| 2014/0341624 | A1 | 11/2014 | Arai et al. |
| 2014/0341625 | A1 | 11/2014 | Imada et al. |
| 2014/0341626 | A1 | 11/2014 | Mimbu et al. |
| 2014/0341627 | A1 | 11/2014 | Yoshikawa et al. |
| 2014/0356036 | A1 | 12/2014 | Shimokawa et al. |
| 2014/0356037 | A1 | 12/2014 | Shimokawa et al. |
| 2014/0356038 | A1 | 12/2014 | Arai et al. |
| 2015/0055993 | A1 | 2/2015 | Shoji |
| 2015/0055994 | A1 | 2/2015 | Shoji et al. |
| 2015/0078768 | A1 | 3/2015 | Yamaguchi et al. |
| 2015/0110531 | A1 | 4/2015 | Takagi et al. |
| 2015/0125193 | A1 | 5/2015 | Ishii et al. |
| 2015/0185671 | A1 | 7/2015 | Ikebuchi et al. |
| 2015/0261149 | A1 | 9/2015 | Seshita et al. |
| 2015/0261155 | A1 | 9/2015 | Yoshiura et al. |
| 2015/0261157 | A1 | 9/2015 | Yamano et al. |

OTHER PUBLICATIONS

U.S. Appl. No. 14/793,949, filed Jul. 8, 2015.
U.S. Appl. No. 14/806,558, filed Jul. 22, 2015.
U.S. Appl. No. 14/836,129, filed Aug. 26, 2015.

* cited by examiner

FIXING DEVICE AND IMAGE FORMING APPARATUS WITH A ROTATABLE LIGHT SHIELD

CROSS-REFERENCE TO RELATED APPLICATION

This patent application is based on and claims priority pursuant to 35 U.S.C. §119 to Japanese Patent Application No. 2014-242984, filed on Dec. 1, 2014, in the Japanese Patent Office, the entire disclosure of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a fixing rotator rotatable in a predetermined direction of rotation and a pressure rotator disposed opposite the fixing rotator. A nip formation pad presses against the pressure rotator via the fixing rotator to form a fixing nip therebetween, through which a recording medium bearing a toner image is conveyed. The nip formation pad includes a base having a basic thermal conductivity and a first thermal conductor sandwiched between the base and the fixing rotator at the fixing nip and having a first thermal conductivity greater than the basic thermal conductivity of the base. A first heater is disposed opposite an inner circumferential surface of the fixing rotator to heat the fixing rotator. A second heater is disposed opposite the inner circumferential surface of the fixing rotator to heat the fixing rotator. A rotatable light shield moves to a shield position where the light shield is interposed between the second heater and the fixing rotator to shield the fixing rotator from light emitted from the second heater. The second heater is disposed at a location where the light shield screens the second heater more readily than the first heater.

This specification further describes an improved image forming apparatus. In one exemplary embodiment, the image forming apparatus includes an image forming device to form a toner image and a fixing device disposed downstream from the image forming device in a recording medium conveyance direction to fix the toner image on a recording medium. The fixing device includes a fixing rotator rotatable in a predetermined direction of rotation and a pressure rotator disposed opposite the fixing rotator. A nip formation pad presses against the pressure rotator via the fixing rotator to form a fixing nip therebetween, through which a recording medium bearing a toner image is conveyed. The nip formation pad includes a base having a basic thermal conductivity and a first thermal conductor sandwiched between the base and the fixing rotator at the fixing nip and having a first thermal conductivity greater than the basic thermal conductivity of the base. A first heater is disposed opposite an inner circumferential surface of the fixing rotator to heat the fixing rotator. A second heater is disposed opposite the inner circumferential surface of the fixing rotator to heat the fixing rotator. A rotatable light shield moves to a shield position where the light shield is interposed between the second heater and the fixing rotator to shield the fixing rotator from light emitted from the second heater. The second heater is disposed at a location where the light shield screens the second heater more readily than the first heater.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
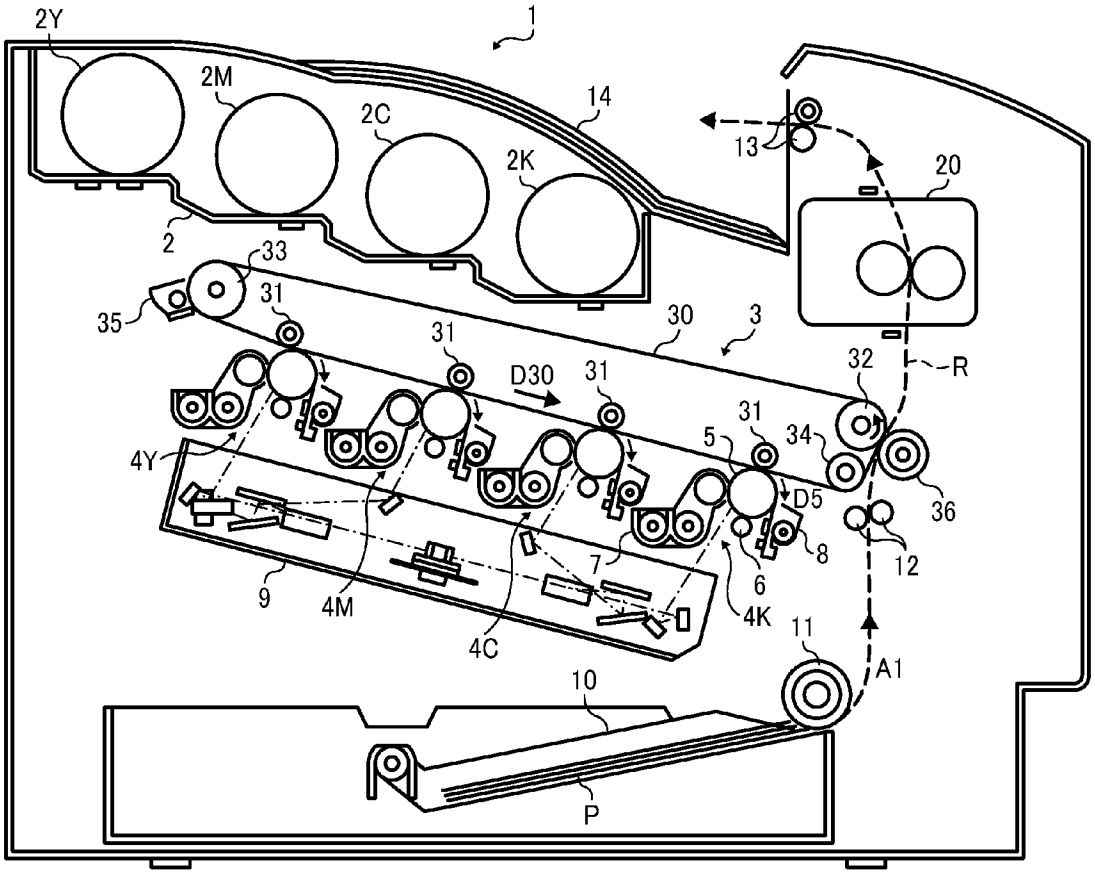
FIG. 1 is a schematic vertical sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color laser printer that forms color and monochrome toner images on a recording medium by electrophotography. Alternatively, the image forming apparatus 1 may be a monochrome printer that forms a monochrome toner image on a recording medium.

With reference to FIG. 1, a description is provided of a construction of the image forming apparatus 1.

As shown in FIG. 1, the image forming apparatus 1 includes four image forming devices 4Y, 4M, 4C, and 4K situated in a center portion thereof. Although the image forming devices 4Y, 4M, 4C, and 4K contain developers (e.g., yellow, magenta, cyan, and black toners) in different colors, that is, yellow, magenta, cyan, and black corresponding to color separation components of a color image, respectively, they have an identical structure.

For example, each of the image forming devices 4Y, 4M, 4C, and 4K includes a drum-shaped photoconductor 5 serving as an image carrier that carries an electrostatic latent image and a resultant toner image; a charger 6 that charges an outer circumferential surface of the photoconductor 5; a developing device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5. It is to be noted that, in FIG. 1, reference numerals are assigned to the photoconductor 5, the charger 6, the developing device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31 serving as primary transferors, a secondary transfer roller 36 serving as a secondary transferor, a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 counterclockwise in FIG. 1 in a rotation direction D30 by friction therebetween.

The four primary transfer rollers 31 sandwich the intermediate transfer belt 30 together with the four photoconductors 5, forming four primary transfer nips between the intermediate transfer belt 30 and the photoconductors 5, respectively. The primary transfer rollers 31 are connected to a power supply that applies a predetermined direct current (DC) voltage and/or alternating current (AC) voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is connected to the power supply that applies a predetermined direct current (DC) voltage and/or alternating current (AC) voltage thereto.

The belt cleaner 35 includes a cleaning brush and a cleaning blade that contact an outer circumferential surface of the intermediate transfer belt 30. A waste toner drain tube extending from the belt cleaner 35 to an inlet of a waste toner container conveys waste toner collected from the intermediate transfer belt 30 by the belt cleaner 35 to the waste toner container.

A bottle holder 2 situated in an upper portion of the image forming apparatus 1 accommodates four toner bottles 2Y, 2M, 2C, and 2K detachably attached thereto to contain and supply fresh yellow, magenta, cyan, and black toners to the developing devices 7 of the image forming devices 4Y, 4M, 4C, and 4K, respectively. For example, the fresh yellow, magenta, cyan, and black toners are supplied from the toner bottles 2Y, 2M, 2C, and 2K to the developing devices 7 through toner supply tubes interposed between the toner bottles 2Y, 2M, 2C, and 2K and the developing devices 7, respectively.

In a lower portion of the image forming apparatus 1 are a paper tray 10 that loads a plurality of sheets P serving as recording media and a feed roller 11 that picks up and feeds a sheet P from the paper tray 10 toward the secondary transfer nip formed between the secondary transfer roller 36 and the intermediate transfer belt 30. The sheets P may be thick paper, postcards, envelopes, plain paper, thin paper, coated paper, art paper, tracing paper, overhead projector (OHP) transparencies, and the like. Optionally, a bypass tray that loads thick paper, postcards, envelopes, thin paper, coated paper, art paper, tracing paper, OHP transparencies, and the like may be attached to the image forming apparatus 1.

A conveyance path R extends from the feed roller 11 to an output roller pair 13 to convey the sheet P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a sheet conveyance direction A1. The registration roller pair 12 serving as a conveyance member conveys the sheet P conveyed from the feed roller 11 toward the secondary transfer nip.

The conveyance path R is further provided with a fixing device 20 (e.g., a fuser or a fusing unit) located above the secondary transfer nip, that is, downstream from the secondary transfer nip in the sheet conveyance direction A1. The fixing device 20 fixes an unfixed toner image transferred from the intermediate transfer belt 30 onto the sheet P conveyed from the secondary transfer nip on the sheet P. The conveyance path R is further provided with the output roller pair 13 located above the fixing device 20, that is, downstream from the fixing device 20 in the sheet conveyance direction A1. The output roller pair 13 ejects the sheet P bearing the fixed toner image onto the outside of the image forming apparatus 1, that is, an output tray 14 disposed atop the image forming apparatus 1. The output tray 14 stocks the sheet P ejected by the output roller pair 13.

With reference to FIG. 1, a description is provided of an image forming operation performed by the image forming apparatus 1 having the construction described above to form a color toner image on a sheet P.

As a print job starts, a driver drives and rotates the photoconductors 5 of the image forming devices 4Y, 4M, 4C, and 4K, respectively, clockwise in FIG. 1 in a rotation direction D5. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, magenta, cyan, and black image data constituting color image data sent from the external device, respectively, thus forming electrostatic latent images thereon. Image data used to expose the respective photoconductors 5 is monochrome image data produced by decomposing a desired full color image into yellow, magenta, cyan, and black image data. The developing devices 7 supply yellow, magenta, cyan, and black toners to the electrostatic latent images formed on the photoconductors 5, visualizing the electrostatic latent images as yellow, magenta, cyan, and black toner images, respectively.

Simultaneously, as the print job starts, the secondary transfer backup roller 32 is driven and rotated counterclockwise in FIG. 1, rotating the intermediate transfer belt 30 in the rotation direction D30 by friction therebetween. The power supply applies a constant voltage or a constant current control voltage having a polarity opposite a polarity of the charged toner to the primary transfer rollers 31, creating a transfer electric field at each primary transfer nip formed between the photoconductor 5 and the primary transfer roller 31.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a full color toner image is formed on the outer circumferential surface of the intermediate transfer belt 30. After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom, respectively. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a sheet P from the paper tray 10 toward the registration roller pair 12 in the conveyance path R. The registration roller pair 12 conveys the sheet P sent to the conveyance path R by the feed roller 11 to the secondary transfer nip formed between the secondary transfer roller 36 and the intermediate transfer belt 30 at a proper time. The secondary transfer roller 36 is applied with a transfer voltage having a polarity opposite a polarity of the charged yellow, magenta, cyan, and black toners constituting the full color toner image formed on the intermediate transfer belt 30, thus creating a transfer electric field at the secondary transfer nip.

As the yellow, magenta, cyan, and black toner images constituting the full color toner image on the intermediate transfer belt 30 reach the secondary transfer nip in accordance with rotation of the intermediate transfer belt 30, the transfer electric field created at the secondary transfer nip secondarily transfers the yellow, magenta, cyan, and black toner images from the intermediate transfer belt 30 onto the sheet P collectively. After the secondary transfer of the full color toner image from the intermediate transfer belt 30 onto the sheet P, the belt cleaner 35 removes residual toner failed to be transferred onto the sheet P and therefore remaining on the intermediate transfer belt 30 therefrom. The removed toner is conveyed and collected into the waste toner container.

Thereafter, the sheet P bearing the full color toner image is conveyed to the fixing device 20 that fixes the full color toner image on the sheet P. Then, the sheet P bearing the fixed full color toner image is ejected by the output roller pair 13 onto the outside of the image forming apparatus 1, that is, the output tray 14 that stocks the sheet P.

The above describes the image forming operation of the image forming apparatus 1 to form the full color toner image on the sheet P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 2:
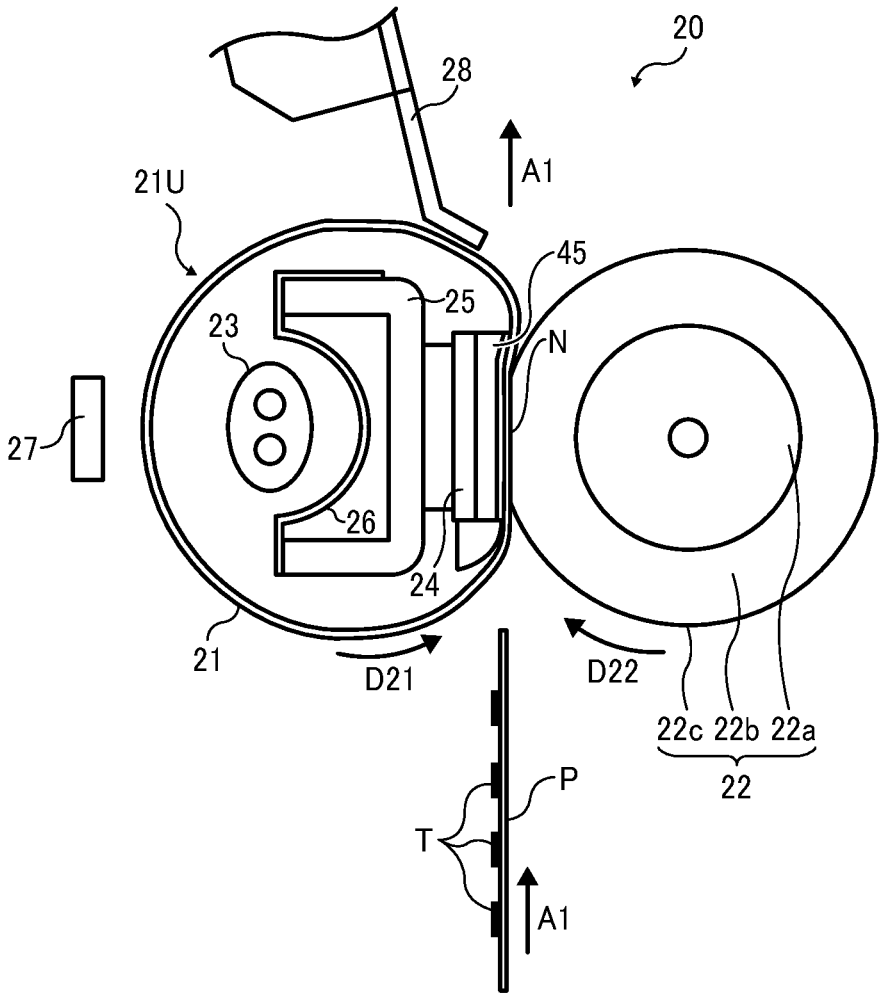
FIG. 2 is a schematic vertical sectional view of a fixing device installed in the image forming apparatus shown in FIG. 1.

With reference to FIG. 2, a description is provided of a construction of the fixing device 20 incorporated in the image forming apparatus 1 described above.

FIG. 2 is a schematic vertical sectional view of the fixing device 20. As shown in FIG. 2, the fixing device 20 (e.g., a fuser or a fusing unit) includes a fixing belt 21 serving as a fixing rotator or an endless belt formed into a loop and rotatable in a rotation direction D21; a pressure roller 22 serving as a pressure rotator disposed opposite an outer circumferential surface of the fixing belt 21 to separably or unseparably contact the fixing belt 21 and rotatable in a rotation direction D22 counter to the rotation direction D21 of the fixing belt 21; a halogen heater pair 23 serving as a heater or a heat source disposed opposite an inner circumferential surface of the fixing belt 21 inside the loop formed by the fixing belt 21 to heat the fixing belt 21; a nip formation pad 24 disposed inside the loop formed by the fixing belt 21 and pressing against the pressure roller 22 via the fixing belt 21 to form a fixing nip N between the fixing belt 21 and the pressure roller 22; a stay 25 serving as a support disposed inside the loop formed by the fixing belt 21 and contacting and supporting the nip formation pad 24; a reflector 26 disposed inside the loop formed by the fixing belt 21 to reflect light radiated from the halogen heater pair 23 toward the fixing belt 21; a temperature sensor 27 serving as a temperature detector disposed opposite the outer circumferential surface of the fixing belt 21 to detect the temperature of the fixing belt 21; and a separator 28 disposed opposite the outer circumferential surface of the fixing belt 21 to separate a sheet P discharged from the fixing nip N from the fixing belt 21. The fixing device 20 further includes a pressurization assembly that presses the pressure roller 22 against the nip formation pad 24 via the fixing belt 21. The fixing belt 21 and the components disposed inside the loop formed by the fixing belt 21, that is, the halogen heater pair 23, the nip formation pad 24, the stay 25, and the reflector 26, may constitute a belt unit 21U separably coupled with the pressure roller 22.

A detailed description is now given of a construction of the fixing belt 21.

The fixing belt 21 is a thin, flexible endless belt or film. For example, the fixing belt 21 is constructed of a base layer constituting the inner circumferential surface of the fixing belt 21 and a release layer constituting the outer circumferential surface of the fixing belt 21. The base layer is made of metal such as nickel and SUS stainless steel or resin such as polyimide (PI). The release layer is made of tetrafluoroethylene-perfluoroalkylvinylether copolymer (PFA), polytetrafluoroethylene (PTFE), or the like. Optionally, an elastic layer made of rubber such as silicone rubber, silicone rubber foam, and fluoro rubber may be interposed between the base layer and the release layer.

A detailed description is now given of a construction of the pressure roller 22.

The pressure roller 22 is constructed of a cored bar 22*a*; an elastic layer 22*b* coating the cored bar 22*a* and made of silicone rubber foam, silicone rubber, fluoro rubber, or the like; and a release layer 22*c* coating the elastic layer 22*b* and made of PFA, PTFE, or the like. The pressurization assembly presses the pressure roller 22 against the nip formation pad 24 via the fixing belt 21 to form the fixing nip N between the fixing belt 21 and the pressure roller 22. Thus, the pressure roller 22 pressingly contacting the fixing belt 21 deforms the elastic layer 22*b* of the pressure roller 22 at the fixing nip N formed between the pressure roller 22 and the fixing belt 21, thus defining the fixing nip N having a predetermined length in the sheet conveyance direction A1. A driver (e.g., a motor) disposed inside the image forming apparatus 1 depicted in FIG. 1 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 by friction between the pressure roller 22 and the fixing belt 21. Alternatively, the driver may also be connected to the fixing belt 21 to drive and rotate the fixing belt 21.

According to this exemplary embodiment, the pressure roller 22 is a solid roller. Alternatively, the pressure roller 22 may be a hollow roller. In this case, a heater such as a halogen heater may be disposed inside the hollow roller. If the hollow pressure roller does not incorporate the elastic layer, the pressure roller has a decreased thermal capacity that improves fixing property of being heated quickly to a predetermined fixing temperature at which a toner image T is fixed on a sheet P properly. However, as the pressure roller 22 and the fixing belt 21 sandwich and press the unfixed toner image T on the sheet P passing through the fixing nip N, slight surface asperities of the fixing belt 21 may be transferred onto the toner image T on the sheet P, resulting in variation in gloss of the solid toner image T. To address this circumstance, it is preferable that the pressure roller 22 incorporates the elastic layer 22*b* having a thickness not smaller than 100 micrometers. The elastic layer 22*b* having the thickness not smaller than 100 micrometers elastically deforms to absorb slight surface asperities of the fixing belt 21, preventing variation in gloss of the toner image T on the sheet P. The elastic layer 22*b* may be made of solid rubber. Alternatively, if no heater is situated inside the pressure roller 22, the elastic layer 22*b* may be made of sponge rubber. The sponge rubber is more preferable than the solid rubber because it has an increased insulation that draws less heat from the fixing belt 21. According to this exemplary embodiment, the pressure roller 22 is pressed against the fixing belt 21. Alternatively, the pressure roller 22 may merely contact the fixing belt 21 with no pressure therebetween.

A detailed description is now given of a configuration of the halogen heater pair 23.

Both lateral ends of the halogen heater pair 23 in a longitudinal direction thereof parallel to an axial direction of the fixing belt 21 are mounted on side plates of the fixing device 20, respectively. The power supply situated inside the image forming apparatus 1 supplies power to the halogen heater pair 23 so that the halogen heater pair 23 is controlled to heat the fixing belt 21. A controller (e.g., a processor), that is, a central processing unit (CPU) provided with a random-access memory (RAM) and a read-only memory (ROM), for example, operatively connected to the halogen heater pair 23 and the temperature sensor 27 controls the halogen heater pair 23 based on the temperature of the outer circumferential surface of the fixing belt 21 detected by the temperature sensor 27 so as to adjust the temperature of the fixing belt 21 to a desired fixing temperature. Alternatively, instead of the halogen heater pair 23, an induction heater, a resistive heat generator, a carbon heater, or the like may be employed as a heater or a heat source that heats the fixing belt 21.

A detailed description is now given of a configuration of the nip formation pad 24.

The nip formation pad 24 extends in the axial direction of the fixing belt 21 or the pressure roller 22 such that a longitudinal direction of the nip formation pad 24 is parallel to the axial direction of the fixing belt 21 or the pressure roller 22. The nip formation pad 24 is mounted on and supported by the stay 25. Accordingly, even if the nip formation pad 24 receives pressure from the pressure roller 22, the nip formation pad 24 is not bent by the pressure and therefore produces a uniform nip width throughout the entire width of the pressure roller 22 in the axial direction thereof. The stay 25 is made of metal having an increased mechanical strength, such as stainless steel and iron, to prevent bending of the nip formation pad 24. Alternatively, the stay 25 may be made of resin.

The nip formation pad 24 is made of a heat resistant material resistant against temperatures not lower than about 200 degrees centigrade. Thus, the nip formation pad 24 is immune from thermal deformation at temperatures in a fixing temperature range desirable to fix the toner image T on the sheet P, retaining the shape of the fixing nip N and quality of the toner image T formed on the sheet P. For example, the nip formation pad 24 is made of general heat resistant resin such as polyether sulfone (PES), polyphenylene sulfide (PPS), liquid crystal polymer (LCP), polyether nitrile (PEN), polyamide imide (PAI), and polyether ether ketone (PEEK). According to this exemplary embodiment, the nip formation pad 24 is made of LCP TI-8000 available from Toray Industries, Inc.

The nip formation pad 24 is coated with a low-friction sheet. As the fixing belt 21 rotates in the rotation direction D21, the fixing belt 21 slides over the low-friction sheet that reduces a driving torque developed between the fixing belt 21 and the nip formation pad 24, reducing load exerted to the fixing belt 21 by friction between the fixing belt 21 and the nip formation pad 24. For example, the low-friction sheet is made of TOYOFLON® 401 available from Toray Industries, Inc.

A detailed description is now given of a configuration of the reflector 26.

The reflector 26 is interposed between the stay 25 and the halogen heater pair 23. According to this exemplary embodiment, the reflector 26 is mounted on the stay 25. Since the reflector 26 is heated by the halogen heater pair 23 directly, the reflector 26 is made of metal having an increased melting point or the like. The reflector 26 interposed between the halogen heater pair 23 and the stay 25 reflects light radiated from the halogen heater pair 23 to the stay 25 toward the fixing belt 21, increasing an amount of light that irradiates the fixing belt 21 and thereby heating the fixing belt 21 effectively. Additionally, the reflector 26 suppresses conduction of heat from the halogen heater pair 23 to the stay 25 and the like, saving energy.

Alternatively, instead of installation of the reflector 26, an opposed face of the stay 25 disposed opposite the halogen heater pair 23 may be treated with polishing or mirror finishing such as coating to produce a reflection face that reflects light from the halogen heater pair 23 toward the fixing belt 21. For example, the reflector 26 or the reflection face of the stay 25 has a reflection rate of about 90 percent or more.

Since the shape and the material of the stay 25 are not selected flexibly to retain the mechanical strength, if the reflector 26 is installed in the fixing device 20 separately from the stay 25, the reflector 26 and the stay 25 provide flexibility in the shape and the material, attaining properties peculiar to them, respectively. The reflector 26 interposed between the halogen heater pair 23 and the stay 25 is situated in proximity to the halogen heater pair 23, reflecting light from the halogen heater pair 23 toward the fixing belt 21 to heat the fixing belt 21 effectively.

In order to save energy and shorten a first print time taken to output the sheet P bearing the fixed toner image T upon receipt of a print job through preparation for a print operation and the subsequent print operation, the fixing device 20 is configured as below. For example, the fixing device 20 employs a direct heating method in which the halogen heater pair 23 heats the fixing belt 21 directly in a circumferential direct heating span on the fixing belt 21 other than the fixing nip N. As shown in FIG. 2, no component is interposed between the halogen heater pair 23 and the fixing belt 21 in the circumferential, direct heating span on the fixing belt 21 on the left of the halogen heater pair 23 where the halogen heater pair 23 heats the fixing belt 21 directly.

In order to decrease the thermal capacity of the fixing belt 21, the fixing belt 21 is thin and has a decreased loop diameter. For example, the fixing belt 21 is constructed of the base layer having a thickness in a range of from 20 micrometers to 50 micrometers; the elastic layer having a thickness in a range of from 100 micrometers to 300 micrometers; and the release layer having a thickness in a range of from 10 micrometers to 50 micrometers. Thus, the fixing belt 21 has a total thickness not greater than 1 mm. A loop diameter of the fixing belt 21 is in a range of from 20 mm to 40 mm. In order to decrease the thermal capacity of the fixing belt 21 further, the fixing belt 21 may have a total thickness not greater than 0.20 mm and preferably not greater than 0.16 mm. Additionally, the loop diameter of the fixing belt 21 may not be greater than 30 mm.

According to this exemplary embodiment, the pressure roller 22 has a diameter in a range of from 20 mm to 40 mm. Hence, the loop diameter of the fixing belt 21 is equivalent to the diameter of the pressure roller 22. However, the loop diameter of the fixing belt 21 and the diameter of the pressure roller 22 are not limited to the sizes described above. For example, the loop diameter of the fixing belt 21 may be smaller than the diameter of the pressure roller 22. In this case, a curvature of the fixing belt 21 is greater than a curvature of the pressure roller 22 at the fixing nip N, facilitating separation of the sheet P from the fixing belt 21 as it is ejected from the fixing nip N. A bulge 45 projects from a downstream end of the nip formation pad 24 in proximity to an exit of the fixing nip N toward the pressure roller 22. The bulge 45 does not press against the pressure roller 22 via the fixing belt 21 and therefore is not produced by contact with the pressure roller 22. The bulge 45 lifts the sheet P bearing the fixed toner image T that is conveyed through the exit of the fixing nip N from the fixing belt 21, facilitating separation of the sheet P from the fixing belt 21.

Figure 3:
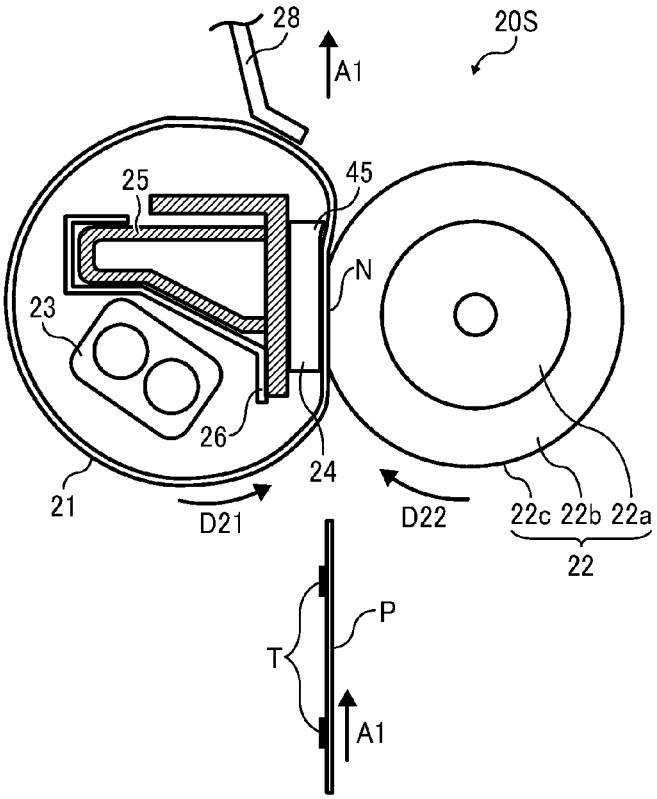
FIG. 3 is a schematic vertical sectional view of another fixing device installable in the image forming apparatus shown in FIG. 1.

With reference to FIG. 3, a description is provided of a construction of a fixing device 20S according to another exemplary embodiment incorporated in the image forming apparatus 1 described above.

FIG. 3 is a schematic vertical sectional view of the fixing device 20S. As shown in FIG. 3, the fixing device 20S (e.g., a fuser or a fusing unit) includes the halogen heater pair 23 serving as a heater or a heat source disposed opposite the inner circumferential surface of the fixing belt 21 inside the loop formed by the fixing belt 21 to heat the fixing belt 21 directly with light irradiating the inner circumferential surface of the fixing belt 21. The shape of the stay 25 and the reflector 26 of the fixing device 20S is different from the shape of the stay 25 and the reflector 26 of the fixing device 20 depicted in FIG. 2. Like the fixing device 20 shown in FIG. 2, the fixing device 20S shown in FIG. 3 includes the bulge 45 projecting from the downstream end of the nip formation pad 24 in proximity to the exit of the fixing nip N toward the pressure roller 22. The bulge 45 does not press against the pressure roller 22 via the fixing belt 21 and therefore is not produced by contact with the pressure roller 22. The bulge 45 lifts the sheet P bearing the fixed toner image T that is conveyed through the exit of the fixing nip N from the fixing belt 21, facilitating separation of the sheet P from the fixing belt 21.

With reference to FIGS. 4, 5A, 5B, and 5C, a description is provided of a configuration of a comparative fixing device 20C that suffers from overheating or temperature increase of both lateral ends of the fixing belt 21 in the axial direction thereof.

Figure 4:
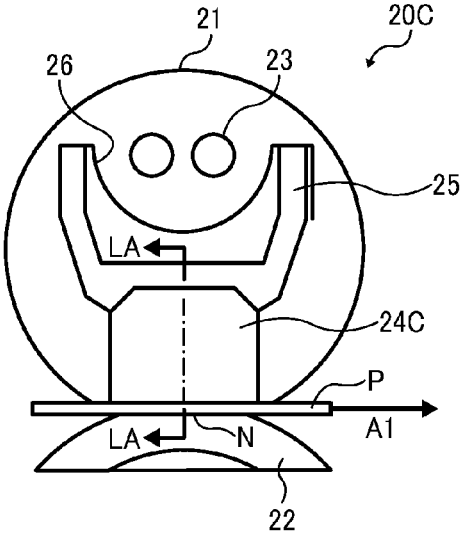
FIG. 4 is a partial schematic vertical sectional view of a comparative fixing device.

FIG. 4 is a partial schematic vertical sectional view of the comparative fixing device 20C. In the comparative fixing device 20C, heat conducted from the halogen heater pair 23 to the fixing belt 21 is further conducted from the fixing belt 21 to the medium and the components that contact the fixing belt 21. For example, heat is conducted from the outer circumferential surface of the fixing belt 21 to the pressure roller 22 that contacts the outer circumferential surface of the fixing belt 21 at the fixing nip N and to the sheet P and toner of the toner image T on the sheet P as the sheet P is conveyed through the fixing nip N. Heat is conducted from the inner circumferential surface of the fixing belt 21 to a comparative nip formation pad 24C that contacts the inner circumferential surface of the fixing belt 21. The comparative nip formation pad 24C is made of resin having a decreased thermal conductivity and therefore draws a decreased amount of heat from the fixing belt 21. Accordingly, as a plurality of small sheets P having a decreased width in the axial direction of the fixing belt 21 is conveyed through the fixing nip N continuously, the fixing belt 21 stores heat at each lateral end in the axial direction thereof, that is, a non-conveyance span, where the small sheets P are not conveyed over the fixing belt 21 and therefore do not draw heat from the fixing belt 21. Consequently, the fixing belt 21 suffers from overheating or temperature increase in the non-conveyance span as the small sheets P having the decreased width that is smaller than a light emission span H of the halogen heater pair 23 spanning in the longitudinal direction thereof are conveyed through the fixing nip N continuously.

Figure 5A:
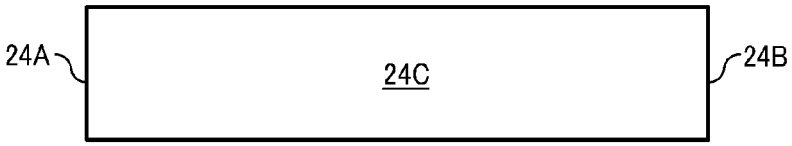
FIG. 5A is a sectional view of a comparative nip formation pad incorporated in the comparative fixing device shown in FIG. 4 taken along line LA-LA in FIG. 4.
Figure 5B:
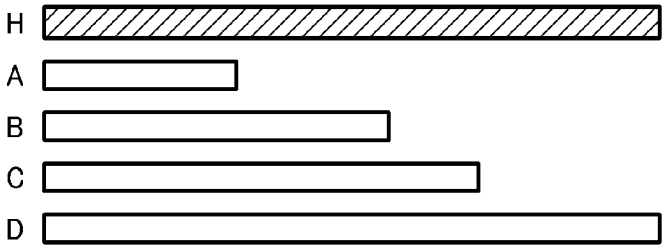
FIG. 5B is a diagram illustrating positional relations between a light emission span of a halogen heater pair incorporated in the comparative fixing device shown in FIG. 4 and four conveyance spans of sheets of four sizes.
Figure 5C:
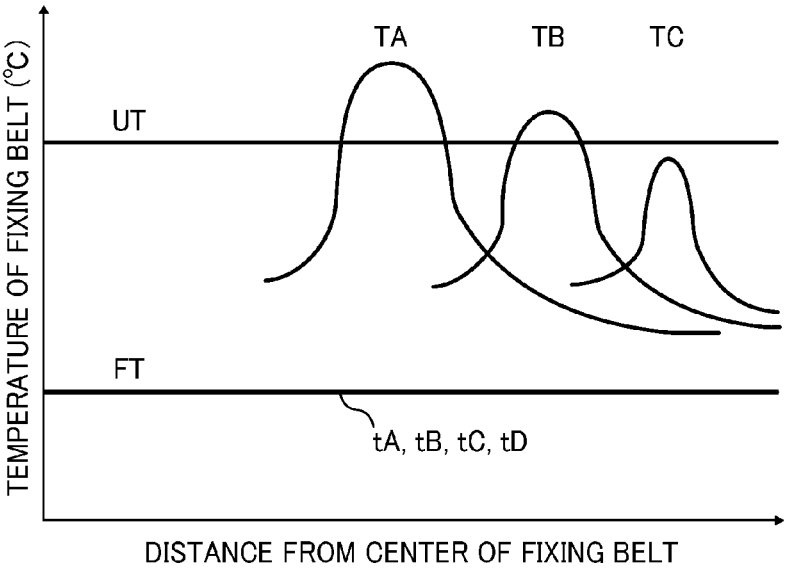
FIG. 5C is a graph showing a relation between the distance from a center of a fixing belt incorporated in the comparative fixing device shown in FIG. 4 and the temperature of the fixing belt in the conveyance spans as sheets of four sizes are conveyed over the fixing belt.

FIG. 5A is a sectional view of the comparative nip formation pad 24C taken along line LA-LA in FIG. 4. It is to be noted that FIG. 5A illustrates a half of the comparative nip formation pad 24C in a longitudinal direction thereof parallel to the axial direction of the fixing belt 21 from a center 24A to a lateral edge 24B of the comparative nip formation pad 24C in the longitudinal direction thereof. FIG. 5B is a diagram illustrating positional relations between the light emission span H of the halogen heater pair 23 and four conveyance spans A, B, C, and D of sheets P of four sizes in the longitudinal direction of the halogen heater pair 23 parallel to the axial direction of the fixing belt 21. FIG. 5C is a graph showing a relation between the distance from a center of the fixing belt 21 in the axial direction thereof and the temperature of the fixing belt 21 in the conveyance spans A, B, C, and D as sheets P of four sizes are conveyed over the fixing belt 21. FIG. 5C illustrates temperatures TA, TB, and TC in the non-conveyance span, that is, a lateral end span on the fixing belt 21 in the axial direction thereof, where the sheet P is not conveyed over the fixing belt 21 and temperatures tA, tB, tC, and tD in the conveyance spans A, B, C, and D, that is, a center span on the fixing belt 21 in the axial direction thereof, where the sheet P is conveyed over the fixing belt 21.

For instance, when a plurality of sheets P having the smallest width is conveyed over the smallest conveyance span A on the fixing belt 21 continuously, the temperature TA of the fixing belt 21 increases in the greatest non-conveyance span outboard from the smallest conveyance span A in the axial direction of the fixing belt 21. However, since the temperature of the halogen heater pair 23 increases to an increased temperature at a center in the longitudinal direction thereof whereas the temperature of the halogen heater pair 23 increases to a decreased temperature at a lateral end in the longitudinal direction thereof, the temperature TA of the fixing belt 21 marks a peak at a position outboard from the conveyance span A and decreases gently toward a lateral edge of the fixing belt 21 in the axial direction thereof. Contrarily, when a sheet P having the greatest width is conveyed over the greatest conveyance span D on the fixing belt 21, the sheet P having the greatest width does not produce the non-conveyance span on the fixing belt 21 as it is conveyed over the fixing belt 21. Accordingly, the temperature of the fixing belt 21 may barely increase at each lateral end of the fixing belt 21 in the axial direction thereof.

If the diameter, the linear velocity, the productivity, and the like of the fixing belt 21 and the pressure roller 22 are fixed, as the size of the non-conveyance span on the fixing belt 21 that defines a difference between the light emission span H of the halogen heater pair 23 and each of the conveyance spans A, B, C, and D increases, an amount of heat stored in the fixing belt 21 increases, thus accelerating overheating or temperature increase of each lateral end of the fixing belt 21 and producing the temperature TA that is higher than the temperature TB higher than the temperature TC. As a result of overheating or temperature increase of the fixing belt 21, the temperatures TA and TB may be above an upper limit target temperature UT of the fixing belt 21 and the temperature TC may be below the upper limit target temperature UT of the fixing belt 21.

The temperatures tA, tB, tC, and tD denote the temperatures of the conveyance spans A, B, C, and D on the fixing belt 21, respectively, before entering the fixing nip N. Since the comparative nip formation pad 24C is made of resin having a decreased thermal conductivity and therefore does not absorb heat excessively, the conveyance spans A, B, C, and D on the fixing belt 21 are immune from shortage of heat during fixing. Hence, the temperatures tA, tB, tC, and tD of the fixing belt 21 are equivalent to a fixing temperature FT.

The comparative fixing device 20C is requested to shorten a warm-up time taken to heat the fixing belt 21 to a predetermined fixing temperature, that is, a reload temperature, appropriate for fixing a toner image on a sheet P from an ambient temperature after the image forming apparatus 1 is powered on and the first print time taken to output the sheet P bearing the fixed toner image upon receipt of a print job through preparation for a print operation and the subsequent print operation.

Since the comparative fixing device 20C installed in the high speed image forming apparatus 1 is requested to convey an increased number of sheets P per unit time while supplying an increased amount of heat to the sheets P, the comparative fixing device 20C is susceptible to shortage of heat and temperature decrease as continuous conveyance of the plurality of sheets P starts.

To address this circumstance, the comparative fixing device 20C incorporating the fixing belt 21 having a decreased thermal capacity and heated by the halogen heater pair 23 directly not through a metal thermal conductor achieves a desired fixing property of being heated quickly, even if the comparative fixing device 20C is installed in the high speed image forming apparatus 1.

However, since the fixing belt 21 has a decreased thermal capacity, it is susceptible to uneven temperature in the axial direction thereof as described below. As a small sheet P is conveyed through the fixing nip N, the small sheet P creates a conveyance span on the fixing belt 21 where the small sheet P is conveyed over the fixing belt 21 at a center span on the fixing belt 21 in the axial direction thereof and a non-conveyance span on the fixing belt 21 where the small sheet P is not conveyed over the fixing belt 21 at each lateral end span on the fixing belt 21 in the axial direction thereof. The sheet P draws heat from the conveyance span on the fixing belt 21 but does not draw heat from the non-conveyance span on the fixing belt 21. Accordingly, the non-conveyance span on the fixing belt 21 may store heat and overheat to a temperature higher than a predetermined temperature (e.g., the fixing temperature at which the toner image is fixed on the sheet P properly), thus suffering from overheating or temperature increase of each lateral end of the fixing belt 21 in the axial direction thereof.

If each lateral end of the fixing belt 21, that is, the non-conveyance span on the fixing belt 21, suffers from overheating or temperature increase, the material of the fixing belt 21 may be heated to a heat resistant temperature, resulting in degradation and breakage of the fixing belt 21. To address this circumstance, a movable shield plate that shields the fixing belt 21 from light emitted from the halogen heater pair 23 may be installed or an equalization plate that equalizes heat stored in the fixing belt 21 may be disposed opposite the fixing nip N to reduce uneven temperature of the fixing belt 21 in the axial direction thereof and prevent overheating or temperature increase of each lateral end of the fixing belt 21 in the axial direction thereof. However, if the movable shield plate is used, modification of the shape of the reflector 26 may be requested to suppress overheating or temperature increase of each lateral end of the fixing belt 21 when the small sheet P is conveyed over the fixing belt 21 or the shape of the movable shield plate and the position of the halogen heater pair 23 may be restricted, degrading heating efficiency of the halogen heater pair 23. Additionally, the equalization plate may not suppress overheating of temperature increase of each lateral end of the fixing belt 21 in the axial direction thereof effectively when the large sheet P is conveyed over the fixing belt 21.

With reference to FIGS. 6, 7A, 7B, and 7C, a description is provided of a configuration of a fixing device 20 according to a first exemplary embodiment.

Figure 6:
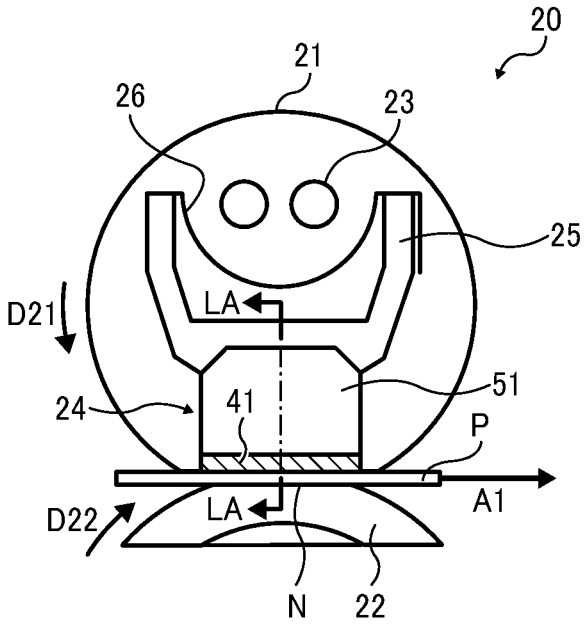
FIG. 6 is a partial schematic vertical sectional view of the fixing device according to a first exemplary embodiment of the present disclosure shown in FIG. 2.

FIG. 6 is a partial schematic vertical sectional view of the fixing device 20. A typical fixing device, for example, the comparative fixing device 20C depicted in FIG. 4, includes the comparative nip formation pad 24C made of resin as a base material and in contact with the fixing belt 21. The comparative nip formation pad 24C is coated with a low-friction sheet. Contrarily, the fixing device 20 shown in FIG. 6 includes the nip formation pad 24 including a base 51 and an equalizer 41 sandwiched between the base 51 and the fixing belt 21. The equalizer 41 extends in a longitudinal direction thereof parallel to the axial direction of the fixing belt 21. The equalizer 41 is made of a material having a thermal conductivity greater than that of the base 51 to absorb excessive heat stored in the non-conveyance span on the fixing belt 21 and conduct the absorbed heat in the longitudinal direction of the equalizer 41. The equalizer 41 serving as a first thermal conductor is sandwiched between the base 51 and the fixing belt 21 at the fixing nip N. According to this exemplary embodiment, the nip formation pad 24 is not coated with the low-friction sheet so as to enhance heat absorption from the fixing belt 21. However, if the equalizer 41 absorbs heat from the fixing belt 21 excessively or if friction between the equalizer 41 and the fixing belt 21 produces a torque that obstructs rotation of the fixing belt 21, the low-friction sheet may coat the nip formation pad 24. As the sheet P is conveyed over the fixing belt 21, the sheet P draws heat from the equalizer 41. Accordingly, heat conducts to a relatively cooler center of the equalizer 41 in the longitudinal direction thereof or a cooler portion at each lateral end of the equalizer 41 in the longitudinal direction thereof that is susceptible to overheating or temperature increase.

Figure 7A:
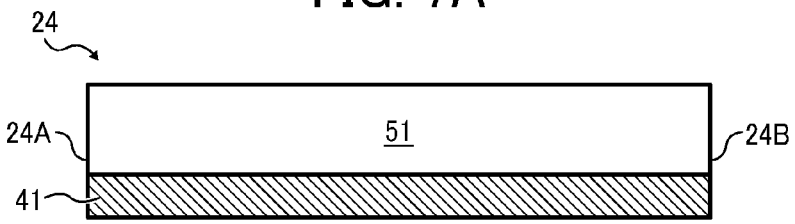
FIG. 7A is a sectional view of a nip formation pad incorporated in the fixing device shown in FIG. 6 taken along line LA-LA in FIG. 6.
Figure 7B:
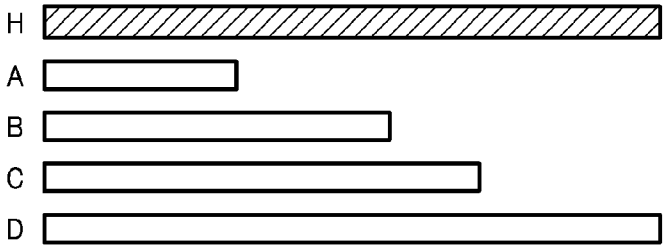
FIG. 7B is a diagram illustrating positional relations between the light emission span of the halogen heater pair incorporated in the fixing device shown in FIG. 6 and the four conveyance spans of sheets of four sizes.
Figure 7C:
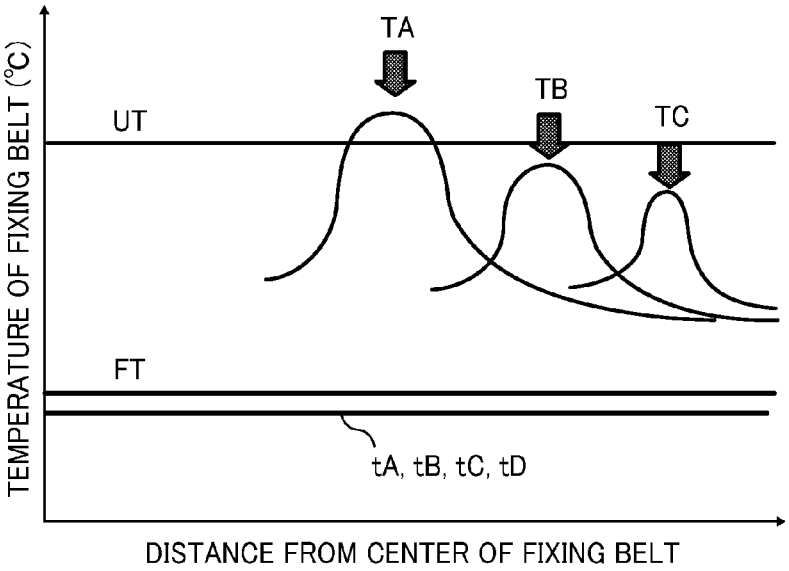
FIG. 7C is a graph showing a relation between the distance from the center of the fixing belt incorporated in the fixing device shown in FIG. 6 and the temperature of the fixing belt.

FIG. 7A is a sectional view of the nip formation pad 24 taken along line LA-LA in FIG. 6. It is to be noted that FIG. 7A illustrates a half of the nip formation pad 24 in the longitudinal direction thereof parallel to the axial direction of the fixing belt 21 from the center 24A to the lateral edge 24B of the nip formation pad 24 in the longitudinal direction thereof. FIG. 7B is a diagram illustrating positional relations between the light emission span H of the halogen heater pair 23 and the four conveyance spans A, B, C, and D of sheets P of four sizes in the axial direction of the fixing belt 21. FIG. 7C is a graph showing a relation between the distance from the center of the fixing belt 21 in the axial direction thereof and the temperature of the fixing belt 21.

The equalizer 41 disposed opposite the fixing nip N extends in a span corresponding to the entire span of the halogen heater pair 23 in the longitudinal direction thereof parallel to the axial direction of the fixing belt 21 as shown in FIG. 7A. Accordingly, regardless of the sizes of sheets P, the equalizer 41 suppresses overheating or temperature increase of both lateral ends of the fixing belt 21 in the axial direction thereof as shown in FIG. 7C. Since the equalizer 41 facilitates conduction of heat in the longitudinal direction thereof and absorbs an increased amount of heat, the equalizer 41 suppresses overheating or temperature increase of both lateral ends of the fixing belt 21 in the axial direction thereof effectively. The equalizer 41 may span the entire non-conveyance span outboard from the smallest conveyance span A of the smallest sheet P in the longitudinal direction of the halogen heater pair 23. Thus, the equalizer 41 reduces overheating or temperature increase of both lateral ends of the fixing belt 21 in the axial direction thereof as the sheets P of various sizes are conveyed over the fixing belt 21. Alternatively, the base 51 disposed opposite the fixing belt 21 via the equalizer 41 may be made of a material having an increased thermal conductivity to increase the thermal capacity of the equalizer 41 and thereby cause the equalizer 41 to suppress overheating or temperature increase of both lateral ends of the fixing belt 21 in the axial direction thereof effectively. The thermal capacity of the equalizer 41 in direct contact with the fixing belt 21 is adjusted to prevent the equalizer 41 from absorbing heat from the fixing belt 21 excessively. At least one of the thickness, the length in a direction perpendicular to the longitudinal direction, and the material (e.g., iron or copper) of the equalizer 41 is selected to prevent the equalizer 41 from absorbing heat from the fixing belt 21 excessively. As shown in FIG. 7C, the equalizer 41 suppresses the temperature TB of the non-conveyance span outboard from the conveyance span B on the fixing belt 21 in the axial direction thereof and the temperature TC of the non-conveyance span outboard from the conveyance span C on the fixing belt 21 in the axial direction thereof to the upper limit target temperature UT of the fixing belt 21 or lower.

The equalizer 41 is made of metal such as copper. Alternatively, the equalizer 41 may be made of resin in accordance with overheating or temperature increase in the non-conveyance span produced at both lateral ends of the fixing belt 21 in the axial direction thereof.

The equalizer 41 achieves flexibility in designing the thickness and the width to correspond to the sheets P of various sizes. As the width of the equalizer 41 increases in the longitudinal direction thereof, the equalizer 41 suppresses overheating or temperature increase of both lateral ends of the fixing belt 21 in the axial direction thereof effectively. However, as the width of the equalizer 41 increases in the longitudinal direction thereof, heat conducts outboard to each lateral edge of the fixing belt 21 in the axial direction. Accordingly, both lateral ends of the fixing belt 21 in the axial direction thereof may suffer from temperature decrease immediately after the fixing device 20 is powered on. To address this circumstance, the width of the equalizer 41 in the longitudinal direction thereof is designed substantially to a width of a maximum sheet P available in the image forming apparatus 1 (e.g., an A3 extension size sheet according to this exemplary embodiment), thus preventing temperature decrease of both lateral ends of the fixing belt 21 in the axial direction thereof. Accordingly, when a large sheet P (e.g., B4 and A3 size sheets in portrait orientation) is conveyed over the fixing belt 21, a decreased span of the equalizer 41 in the longitudinal direction thereof is disposed opposite the non-conveyance span on the fixing belt 21 that is outboard from the conveyance span where the large sheet P is conveyed and is susceptible to overheating or temperature increase. Consequently, the equalizer 41 suppresses overheating or temperature increase of both lateral ends of the fixing belt 21 in the axial direction thereof less effectively compared to when a small sheet P is conveyed over the fixing belt 21.

With reference to FIGS. 8, 9A, 9B, and 9C, a description is provided of a configuration of a fixing device 20T according to a second exemplary embodiment.

Figure 8:
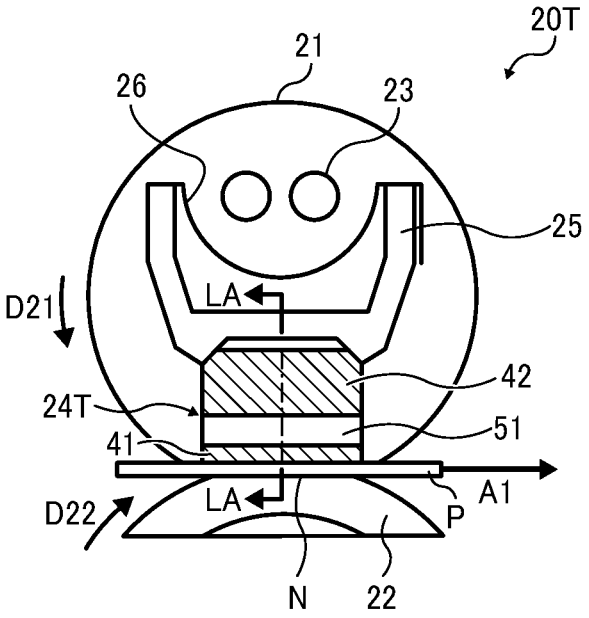
FIG. 8 is a partial schematic vertical sectional view of a fixing device according to a second exemplary embodiment of the present disclosure.

FIG. 8 is a partial schematic vertical sectional view of the fixing device 20T. The fixing device 20T (e.g., a fuser or a fusing unit) includes the equalizer 41 serving as the first thermal conductor sandwiched between the base 51 and the fixing belt 21 at the fixing nip N and extended in the longitudinal direction thereof parallel to the axial direction of the fixing belt 21. The equalizer 41 is made of a material having a thermal conductivity greater than that of the base 51. The fixing device 20T further includes an absorber 42 serving as a third thermal conductor extended in a longitudinal direction thereof parallel to the axial direction of the fixing belt 21. The absorber 42 is disposed opposite the fixing belt 21 via the base 51 and the equalizer 41 at the fixing nip N and in contact with the base 51. The absorber 42 is made of a material having a thermal conductivity greater than that of the base 51.

Figure 9A:
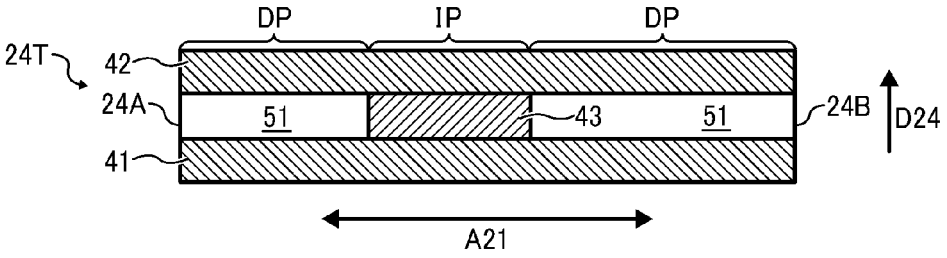
FIG. 9A is a sectional view of a nip formation pad incorporated in the fixing device shown in FIG. 8 taken along line LA-LA in FIG. 8.

FIG. 9A is a sectional view of a nip formation pad 24T taken along line LA-LA in FIG. 8. It is to be noted that FIG. 9A illustrates a half of the nip formation pad 24T in a longitudinal direction thereof parallel to the axial direction of the fixing belt 21 from the center 24A to the lateral edge 24B of the nip formation pad 24T in the longitudinal direction thereof. As shown in FIG. 9A, an absorber 43 serving as a second thermal conductor that is smaller than the equalizer 41 and the absorber 42 in the longitudinal direction of the equalizer 41 and the absorber 43 is sandwiched between the equalizer 41 and the absorber 42 and disposed opposite the fixing nip N via the equalizer 41. For example, the absorber 43 is disposed opposite a part of the fixing belt 21 in the axial direction thereof. The absorber 43 is sandwiched between the bases 51 in the longitudinal direction of the equalizer 41 and made of a material having a thermal conductivity greater than that of the base 51.

Figure 9B:
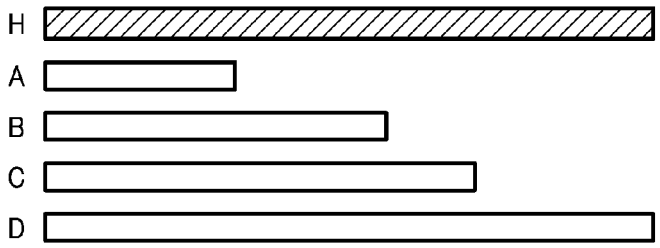
FIG. 9B is a diagram illustrating positional relations between the light emission span of the halogen heater pair incorporated in the fixing device shown in FIG. 8 and the four conveyance spans of sheets of four sizes.
Figure 9C:
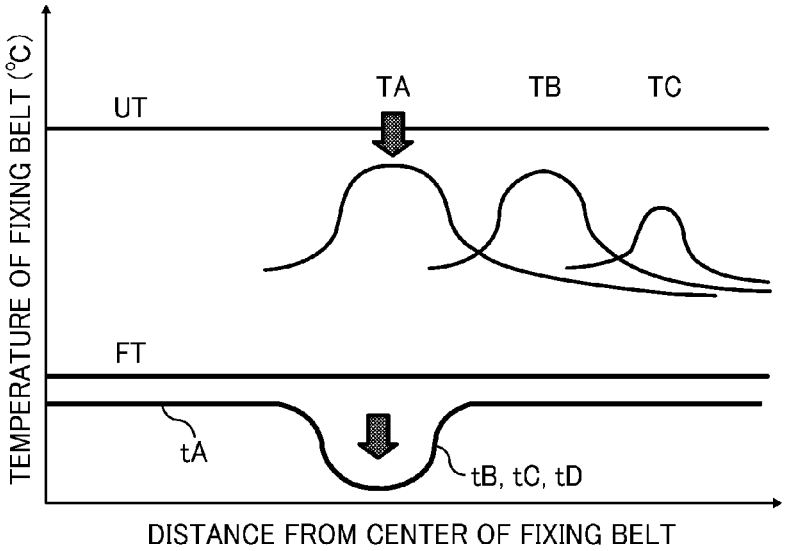
FIG. 9C is a graph showing a relation between the distance from the center of the fixing belt incorporated in the fixing device shown in FIG. 8 and the temperature of the fixing belt.

FIG. 9B is a diagram illustrating positional relations between the light emission span H of the halogen heater pair 23 and the four conveyance spans A, B, C, and D of sheets P of four sizes in the axial direction of the fixing belt 21. FIG. 9C is a graph showing a relation between the distance from the center of the fixing belt 21 in the axial direction thereof and the temperature of the fixing belt 21. The absorber 43 is disposed opposite the non-conveyance span that is outboard from the conveyance span A on the fixing belt 21 in the axial direction thereof and is susceptible to overheating or temperature increase at the temperature TA depicted in FIG. 9C. As shown in FIGS. 8 and 9A, the nip formation pad 24T includes the base 51, the equalizer 41, and the absorbers 42 and 43.

As shown in FIG. 9A, the nip formation pad 24T is divided into a plurality of portions defined by the thermal conductivity: a decreased thermal conductivity portion DP and an increased thermal conductivity portion IP. The increased thermal conductivity portion IP is constructed of a plurality of materials, that is, the equalizer 41 and the absorbers 43 and 42. The decreased thermal conductivity portion DP is constructed of a plurality of materials, that is, the equalizer 41, the base 51, and the absorber 42. The thermal conductivity of the base 51 is different from that of the equalizer 41 and the absorbers 42 and 43. For example, the thermal conductivity of the equalizer 41 and the absorbers 42 and 43 is greater than that of the base 51. Thus, the nip formation pad 24T is constructed of the plurality of materials having different thermal conductivities, respectively, that is layered in a thickness direction D24 perpendicular to an axial direction A21 of the fixing belt 21.

A total thermal conductivity in the thickness direction D24, that is, vertically in FIG. 9A, of the nip formation pad 24T in the increased thermal conductivity portion IP including the absorber 43 having an increased thermal conductivity is greater than that of the decreased thermal conductivity portion DP not including the absorber 43. The increased thermal conductivity portion IP including the absorber 43 absorbs heat from the fixing belt 21 depicted in FIG. 8 readily. Even if the fixing belt 21 suffers from overheating or temperature increase at a portion of the fixing belt 21 that is disposed opposite the increased thermal conductivity portion IP of the nip formation pad 24T, the increased thermal conductivity portion IP of the nip formation pad 24T absorbs heat from the fixing belt 21 and conducts heat in the thickness direction D24 of the nip formation pad 24T, that is, upward in FIG. 9A, thus suppressing overheating or temperature increase of the fixing belt 21. The decreased thermal conductivity portion DP extends within the conveyance span on the fixing belt 21.

The equalizer 41 facilitates conduction of heat in the longitudinal direction thereof parallel to the axial direction of the fixing belt 21, equalizing an amount of heat stored in the fixing belt 21 and thereby suppressing overheating or temperature increase of both lateral ends of the fixing belt 21 in the axial direction thereof. Conversely, the absorbers 42 and 43 facilitate conduction of heat in the thickness direction D24 of the nip formation pad 24T perpendicular to the longitudinal direction thereof and absorb heat from the equalizer 41. As shown in FIGS. 9A and 9C, the absorber 43 is disposed opposite the greater non-conveyance span on the fixing belt 21 that is outboard from the smaller conveyance span A on the fixing belt 21 in the axial direction thereof and is susceptible to overheating to the temperature TA. The absorber 43 absorbs heat from the equalizer 41 and conducts the absorbed heat to the absorber 42 in contact with the absorber 43. That is, the absorbers 42 and 43 supplement shortage of thermal capacity of the equalizer 41. For example, the absorber 42 has an increased thermal capacity or an increased surface area to increase heat dissipation. However, since the equalizer 41 has a predetermined thickness in the thickness direction D24 of the nip formation pad 24T, the equalizer 41 absorbs heat in the thickness direction D24. Similarly, since each of the absorbers 42 and 43 has a predetermined width in the longitudinal direction of the nip formation pad 24T, each of the absorbers 42 and 43 equalizes heat in the axial direction of the fixing belt 21. Hence, advantages of the equalizer 41 and the absorbers 42 and 43 are not limited to equalization and absorption of heat, respectively.

As shown in FIG. 8, since the nip formation pad 24T is installed in a limited space inside the loop formed by the fixing belt 21, the absorber 42 is interposed between the base 51 constituting a resin layer and the stay 25 and extended in the longitudinal direction of the nip formation pad 24T parallel to the axial direction of the fixing belt 21. Alternatively, if a space is available, the absorber 42 may be upsized in the axial direction A21 shown in FIG. 9A or a circumferential direction, that is, the rotation direction D21 shown in FIG. 8, of the fixing belt 21 to increase the thermal capacity of the absorber 42. Yet alternatively, the absorber 42 may contact the stay 25 to increase an apparent thermal capacity of the absorber 42. In this case, the stay 25 needs to be cooler than the absorber 42. Accordingly, in order to suppress conduction of heat from the reflector 26 heated by the halogen heater pair 23 to an increased temperature to the stay 25, an air layer or an insulation layer made of an insulation material is interposed between the reflector 26 and the stay 25. Yet alternatively, instead of the absorber 42, the stay 25 having an increased thermal capacity may contact the absorber 43 to absorb heat from the nip formation pad 24T.

As shown in FIG. 9C, the absorbers 42 and 43 prevent the temperature TA of the non-conveyance span that is outboard from the conveyance span A on the fixing belt 21 in the axial direction A21 thereof and is susceptible to substantial overheating or temperature increase from increasing excessively.

The absorbers 42 and 43 are made of metal such as copper. Alternatively, the absorbers 42 and 43 may be made of resin in accordance with an amount of temperature increase in the non-conveyance span produced at both lateral ends of the fixing belt 21 in the axial direction thereof.

A table 1 below shows examples of the material and the thermal conductivity of the equalizer 41 and the absorbers 42 and 43.

TABLE 1

| Material | Thermal conductivity (W/mK) |
|---|---|
| Carbon nanotube | 3,000 to 5,500 |
| Graphite sheet | 700 to 1,750 |
| Silver | 420 |
| Copper | 398 |
| Aluminum | 236 |

A table 2 below shows examples of the material and the thermal conductivity of the base 51.

TABLE 2

| Material (heat resistant resin) | Thermal conductivity (W/mK) |
|---|---|
| Polyphenylene sulfide (PPS) | 0.2 |
| Polyamide imide (PAI) | 0.29 to 0.60 |
| Polyether ether ketone (PEEK) | 0.26 |
| Polyetherketone (PEK) | 0.29 |
| Liquid crystal polymer (LCP) | 0.38 to 0.56 |

With reference to FIGS. 10, 11A, 11B, 11C, and 12, a description is provided of a configuration of a fixing device 20U according to a third exemplary embodiment.

Figure 10:
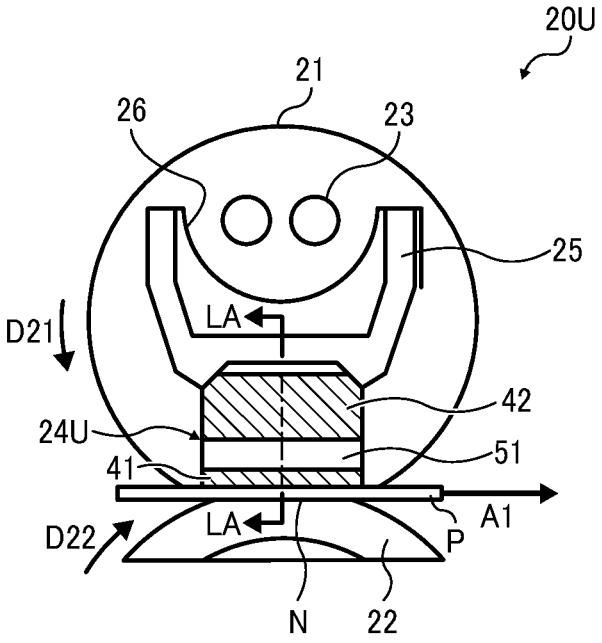
FIG. 10 is a partial schematic vertical sectional view of a fixing device according to a third exemplary embodiment of the present disclosure.
Figure 11A:
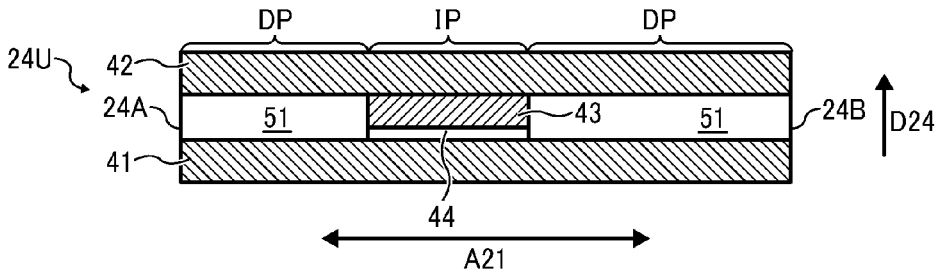
FIG. 11A is a sectional view of a nip formation pad incorporated in the fixing device shown in FIG. 10 taken along line LA-LA in FIG. 10.
Figure 11B:
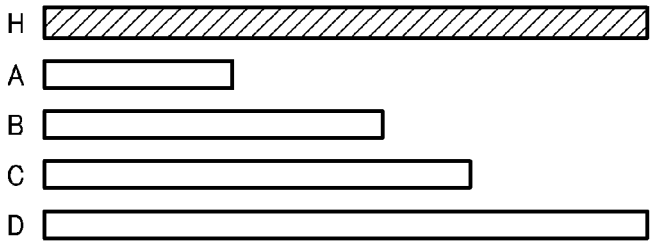
FIG. 11B is a diagram illustrating positional relations between the light emission span of the halogen heater pair incorporated in the fixing device shown in FIG. 10 and the four conveyance spans of sheets of four sizes.
Figure 11C:
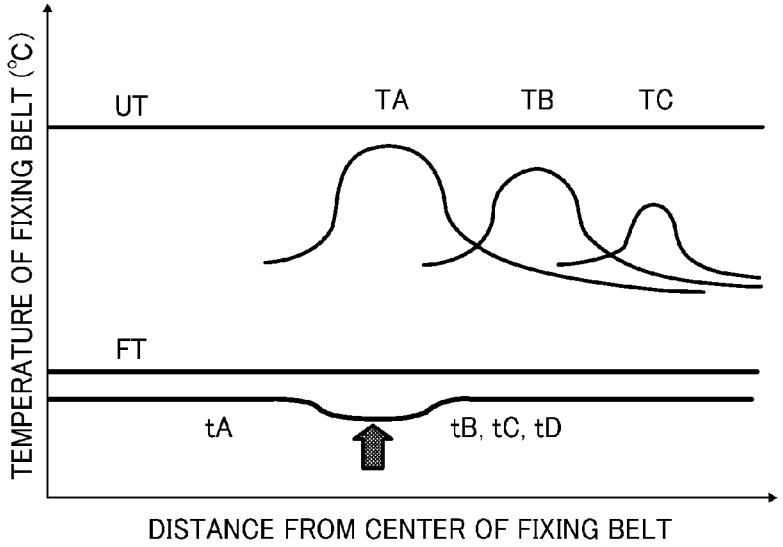
FIG. 11C is a graph showing a relation between the distance from the center of the fixing belt incorporated in the fixing device shown in FIG. 10 and the temperature of the fixing belt.
Figure 12:
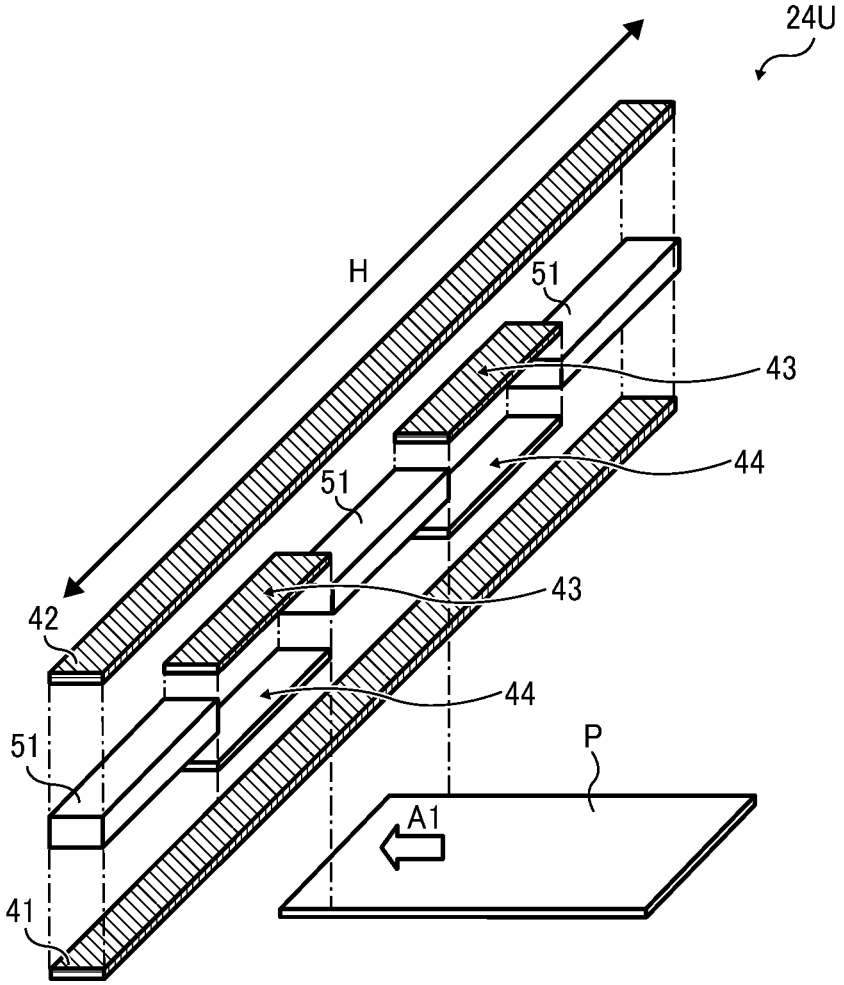
FIG. 12 is a schematic exploded perspective view of the fixing device shown in FIG. 11A illustrating the components disposed opposite a fixing nip.

FIG. 10 is a partial schematic vertical sectional view of the fixing device 20U. FIG. 11A is a sectional view of a nip formation pad 24U taken along line LA-LA in FIG. 10. It is to be noted that FIG. 11A illustrates a half of the nip formation pad 24U in a longitudinal direction thereof parallel to the axial direction of the fixing belt 21 from the center 24A to the lateral edge 24B of the nip formation pad 24U in the longitudinal direction thereof. FIG. 11B is a diagram illustrating positional relations between the light emission span H of the halogen heater pair 23 and the four conveyance spans A, B, C, and D of sheets P of four sizes in the axial direction of the fixing belt 21. FIG. 11C is a graph showing a relation between the distance from the center of the fixing belt 21 in the axial direction thereof and the temperature of the fixing belt 21. FIG. 12 is a schematic exploded perspective view of the fixing device 20U illustrating the components disposed opposite the fixing nip N. FIG. 12 illustrates an A6 size sheet P conveyed in the sheet conveyance direction A1.

As shown in FIGS. 11A and 12, in addition to the components of the fixing device 20T shown in FIGS. 8 and 9A, the fixing device 20U (e.g., a fuser or a fusing unit) further includes a resin layer 44 sandwiched between the equalizer 41 and the absorber 43. As shown in FIGS. 11A and 12, the nip formation pad 24U includes the base 51, the equalizer 41, the absorbers 42 and 43, and the resin layer 44. The resin layer 44 is made of a material having a thermal conductivity smaller than that of the absorber 43 serving as the second thermal conductor. The resin layer 44 interposed between the equalizer 41 and the absorber 43 in contact with the absorber 42 reduces an amount of heat conducted from the equalizer 41 to the absorber 42 through the absorber 43. Accordingly, the temperature TA of the non-conveyance span outboard from the conveyance span A on the fixing belt 21 in the axial direction thereof is suppressed to a temperature lower than the upper limit target temperature UT of the fixing belt 21 and at the same time shortage of heat that may lower the temperature of the fixing belt 21 below the fixing temperature FT, that is, the temperatures tB, tC, and tD, is reduced while saving power as shown in FIG. 11C.

If the resin layer 44 is thick excessively, the thick resin layer 44 may prohibit heat stored in the fixing belt 21 from being conducted to the absorber 42, rendering the fixing belt 21 to be susceptible to overheating or temperature increase of the non-conveyance span produced at both lateral ends of the fixing belt 21 in the axial direction thereof, like the configuration of the fixing device 20 depicted in FIG. 6 without the absorbers 42 and 43. It is necessary to determine the thickness and the width of the resin layer 44 based on the degree of overheating or temperature increase of both lateral ends of the fixing belt 21 in the axial direction thereof. For example, the thickness of the resin layer 44 is smaller than that of the base 51 of the fixing device 20 depicted in FIG. 6. If overheating or temperature increase of both lateral ends of the fixing belt 21 in the axial direction thereof that may not be overcome by the equalizer 41 occurs at a plurality of spots spaced apart from each other, a plurality of absorbers 43 may be disposed opposite the plurality of overheated spots on the fixing belt 21, respectively. For example, as shown in FIG. 12, the plurality of absorbers 43 may be aligned in the longitudinal direction of the equalizer 41. In this case, the thickness and the width of the resin layer 44 are determined based on the degree of overheating or temperature increase at the respective spots on both lateral ends of the fixing belt 21 in the axial direction thereof. The combined thickness of the absorber 43 and the resin layer 44 is substantially equivalent to the thickness of the base 51, allowing the absorber 43 to come into surface contact with the absorber 42 and thereby facilitating conduction of heat from the absorber 43 to the absorber 42 and vice versa.

Like the nip formation pad 24T according to the second exemplary embodiment depicted in FIG. 9A, as shown in FIG. 11A, the nip formation pad 24U according to the third exemplary embodiment is divided into the plurality of portions defined by the thermal conductivity: the decreased thermal conductivity portion DP and the increased thermal conductivity portion IP. The increased thermal conductivity portion IP is constructed of a plurality of materials, that is, the equalizer 41, the resin layer 44, and the absorbers 43 and 42. The decreased thermal conductivity portion DP is constructed of a plurality of materials, that is, the equalizer 41, the base 51, and the absorber 42. A thermal conductivity of the base 51 and the resin layer 44 is different from that of the equalizer 41 and the absorbers 42 and 43. For example, the thermal conductivity of the equalizer 41 and the absorbers 42 and 43 is greater than that of the base 51 and the resin layer 44. Thus, the nip formation pad 24U is constructed of the plurality of materials having different thermal conductivities, respectively, that is layered in the thickness direction D24 thereof perpendicular to the axial direction A21 of the fixing belt 21.

A total thermal conductivity in the thickness direction D24, that is, vertically in FIG. 11A, of the nip formation pad 24U in the increased thermal conductivity portion IP including the absorber 43 having an increased thermal conductivity is greater than a thermal conductivity of the decreased thermal conductivity portion DP not including the absorber 43. The increased thermal conductivity portion IP including the absorber 43 absorbs heat from the fixing belt 21 depicted in FIG. 10 readily. Even if the fixing belt 21 suffers from overheating or temperature increase at a portion of the fixing belt 21 that is disposed opposite the increased thermal conductivity portion IP of the nip formation pad 24U, the increased thermal conductivity portion IP of the nip formation pad 24U absorbs heat from the fixing belt 21 and conducts heat in the thickness direction D24 of the nip formation pad 24U, that is, upward in FIG. 11A, thus suppressing overheating or temperature increase of the fixing belt 21. The decreased thermal conductivity portion DP extends within the conveyance span on the fixing belt 21.

A rim projecting from each lateral end of the equalizer 41 in the sheet conveyance direction A1 toward the absorber 42 may extend throughout the entire span of the equalizer 41 in the longitudinal direction thereof. The equalizer 41 and the rim mounted thereon produce a U-like shape in cross-section that accommodates the base 51, the resin layer 44, and the absorbers 43 and 42 that are layered on the equalizer 41 precisely. Alternatively, a projection may project from an inner face, that is, an upper face in FIG. 12, of the equalizer 41 to engage a through-hole produced in each of the base 51, the resin layer 44, the absorber 43, and the like.

The absorbers 42 and 43 are manufactured as separate components, not as a single component, to reduce manufacturing costs. If the absorbers 42 and 43 are manufactured as a single component, it is necessary to produce a recess that accommodates the base 51 by cutting, increasing manufacturing costs.

A detailed description is now given of the thickness of each of the components of the nip formation pad 24U when a nip length of the fixing nip N in the sheet conveyance direction A1 is about 10 mm.

The equalizer 41 has a thickness in a range of from 0.2 mm to 0.6 mm. The absorber 42 has a thickness in a range of from 1.8 mm to 6.0 mm. The absorber 43 has a thickness in a range of from 1.0 mm to 2.0 mm. The resin layer 44 has a thickness in a range of from 0.5 mm to 1.5 mm. The base 51 has a thickness in a range of from 1.5 mm to 3.5 mm. However, the thickness of those components is not limited to the above.

As described above, the equalizer 41 and the absorbers 42 and 43 suppress overheating or temperature increase of both lateral ends of the fixing belt 21 in the axial direction thereof effectively when a small sheet P is conveyed over the fixing belt 21. Conversely, the equalizer 41 and the absorbers 42 and 43 suppress overheating or temperature increase of both lateral ends of the fixing belt 21 in the axial direction thereof less effectively when a large sheet P is conveyed over the fixing belt 21.

To address this circumstance, the equalizer 41 and the absorbers 42 and 43 suppress overheating or temperature increase of both lateral ends of the fixing belt 21 in the axial direction thereof when a small sheet P is conveyed over the fixing belt 21. Conversely, a shield plate suppresses overheating or temperature increase of both lateral ends of the fixing belt 21 in the axial direction thereof when a large sheet P is conveyed over the fixing belt 21 as described below.

A description is provided of motion of a comparative shield plate 210C.

Figure 13A:
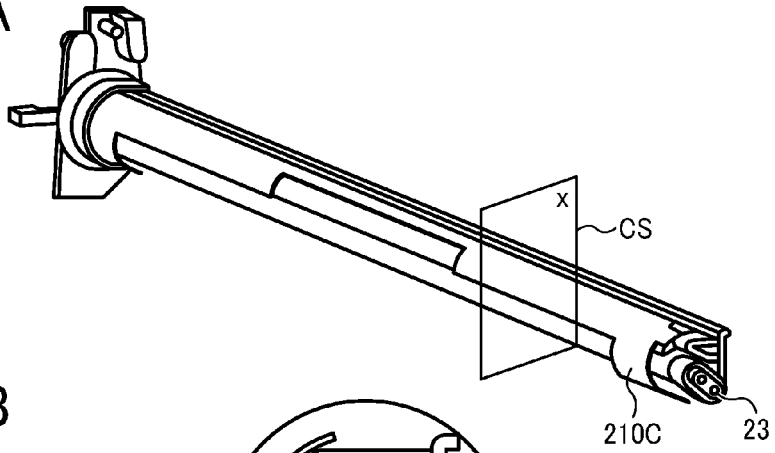
FIG. 13A is a perspective view of a comparative shield plate situated at a decreased shield position when an A3 size sheet as a large sheet is conveyed over the fixing belt.
Figure 13B:
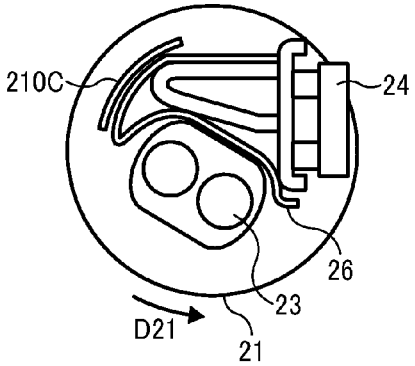
FIG. 13B is a sectional view of the comparative shield plate shown in FIG. 13A taken along a cross-section.
Figure 13C:
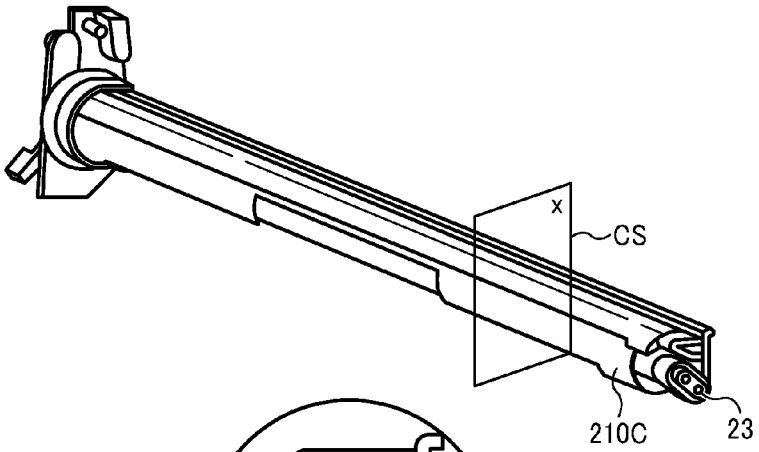
FIG. 13C is a perspective view of the comparative shield plate shown in FIG. 13A situated at an increased shield position as a postcard as a small sheet is conveyed over the fixing belt.
Figure 13D:
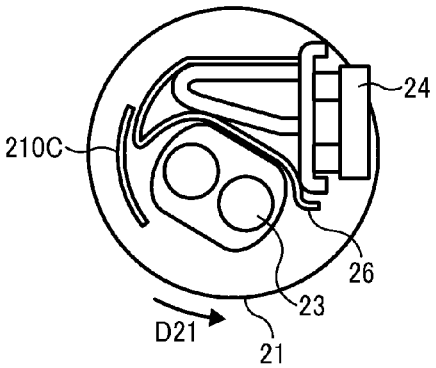
FIG. 13D is a sectional view of the comparative shield plate shown in FIG. 13C taken along the cross-section.
Figure 14:
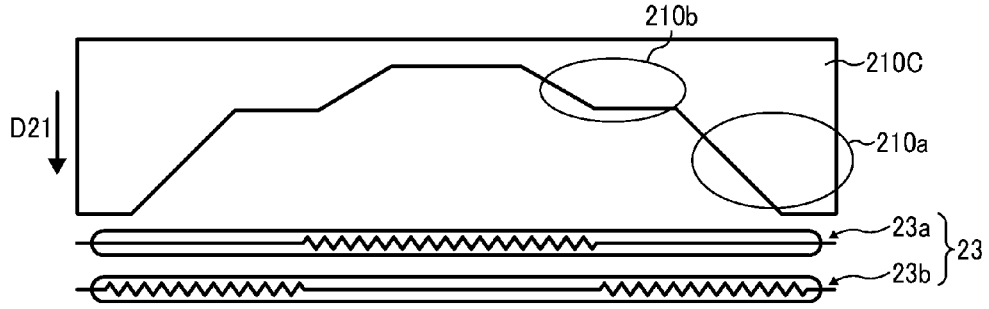
FIG. 14 is an exploded view of the comparative shield plate shown in FIG. 13A.

FIG. 13A is a perspective view of the comparative shield plate 210C situated at a decreased shield position when an A3 size sheet as a large sheet is conveyed over the fixing belt 21. FIG. 13B is a sectional view of the comparative shield plate 210C taken along a cross-section CS in FIG. 13A. FIG. 13C is a perspective view of the comparative shield plate 210C situated at an increased shield position as a postcard as a small sheet is conveyed over the fixing belt 21. FIG. 13D is a sectional view of the comparative shield plate 210C taken along the cross-section CS in FIG. 13C. FIG. 14 is an exploded view of the comparative shield plate 210C.

Fixing devices may employ a rotatable shield plate instead of the equalizer 41 and the absorbers 42 and 43. FIGS. 13A, 13B, 13C, 13D, and 14 illustrate the shape and the positions of the rotatable shield plate (e.g., the comparative shield plate 210C). As shown in FIG. 14, the comparative shield plate 210C serving as a comparative light shield includes an outboard shield portion 210*a*, that is, a lower part of the comparative shield plate 210C in FIG. 14, directed to a large sheet P (e.g., an A3 size sheet) and an inboard shield portion 210*b*, that is, an upper part of the comparative shield plate 210C in FIG. 14, directed to a small sheet P (e.g., a postcard). When the large sheet P is conveyed over the fixing belt 21, the outboard shield portion 210*a* is disposed opposite an outboard part of the halogen heater pair 23 that is outboard from the large sheet P in the axial direction of the fixing belt 21, thus shielding the fixing belt 21 from light emitted from the halogen heater pair 23. When the small sheet P is conveyed over the fixing belt 21, the inboard shield portion 210*b* is disposed opposite an inboard part of the halogen heater pair 23 that is outboard from the small sheet P in the axial direction of the fixing belt 21, thus shielding the fixing belt 21 from light emitted from the halogen heater pair 23.

As shown in FIGS. 13A and 13B, the comparative shield plate 210C rotates to the decreased shield position when the A3 size sheet is conveyed over the fixing belt 21. As shown in FIGS. 13C and 13D, the comparative shield plate 210C rotates to the increased shield position when the postcard is conveyed over the fixing belt 21. Thus, the comparative shield plate 210C suppresses overheating or temperature increase of both lateral ends of the fixing belt 21 in the axial direction thereof. Hence, the comparative shield plate 210C changes a heated span on the fixing belt 21 in the axial direction thereof where the fixing belt 21 is heated by the halogen heater pair 23.

As shown in FIG. 13B, when conveyance of the sheet P to the fixing nip N starts, the comparative shield plate 210C is situated at an upstream standby position in the rotation direction D21 of the fixing belt 21 to wait for the sheet P. When the temperature sensor 27 depicted in FIG. 2 detects overheating or temperature increase of both lateral ends of the fixing belt 21 in the axial direction thereof, the comparative shield plate 210C rotates to a downstream position in the rotation direction D21 of the fixing belt 21 gradually to shield the fixing belt 21 from the halogen heater pair 23 in an overheating span on the fixing belt 21. The comparative shield plate 210C includes an aperture having a plurality of different spans in the axial direction of the fixing belt 21 that increases stepwise downward in FIG. 14 in the rotation direction D21 of the fixing belt 21. As shown in FIG. 14, the halogen heater pair 23 includes a center heater 23*a* that heats the center span on the fixing belt 21 in the axial direction thereof and a lateral end heater 23*b* that heats both lateral end spans on the fixing belt 21 in the axial direction thereof. In order to allow the halogen heater pair 23 to heat the fixing belt 21 in accordance with various sizes of the sheets P, the comparative shield plate 210C is requested to screen both the center heater 23*a* and the lateral end heater 23*b*. To address this request, the center heater 23*a* is disposed upstream from the lateral end heater 23*b* in the rotation direction D21 of the fixing belt 21.

When the postcard is conveyed over the fixing belt 21, the comparative shield plate 210C moves to the downstream, increased shield position shown in FIGS. 13C and 13D. However, the outboard shield portion 210*a* of the comparative shield plate 210C contacts a lower end, that is, an upstream end of the nip formation pad 24 depicted in FIG. 2 in the rotation direction D21 of the fixing belt 21. Thus, the nip formation pad 24 restricts motion of the comparative shield plate 210C. Accordingly, when the postcard is conveyed over the fixing belt 21, the comparative shield plate 210C does not shield the entire overheating span on the fixing belt 21 in the axial direction thereof and therefore does not shield a lower circumferential span on the fixing belt 21 in the circumferential direction thereof from the halogen heater pair 23.

To address this circumstance, the reflector 26 shields the lower circumferential span on the fixing belt 21 from the halogen heater pair 23 when the comparative shield plate 210C is at the increased shield position where the aperture of the comparative shield plate 210C has a predetermined decreased area or smaller to suppress overheating or temperature increase of both lateral ends of the fixing belt 21 in the axial direction thereof when the postcard is conveyed over the fixing belt 21. Since the comparative shield plate 210C is requested to shield the fixing belt 21 from the two heaters, that is, the center heater 23*a* and the lateral end heater 23*b*, overheating or temperature increase of both lateral ends of the fixing belt 21 in the axial direction thereof may not be prevented unless the reflector 26 shields the lower circumferential span on the fixing belt 21 from the halogen heater pair 23 or the halogen heater pair 23 has a decreased irradiation span in the circumferential direction of the fixing belt 21.

Figure 15:
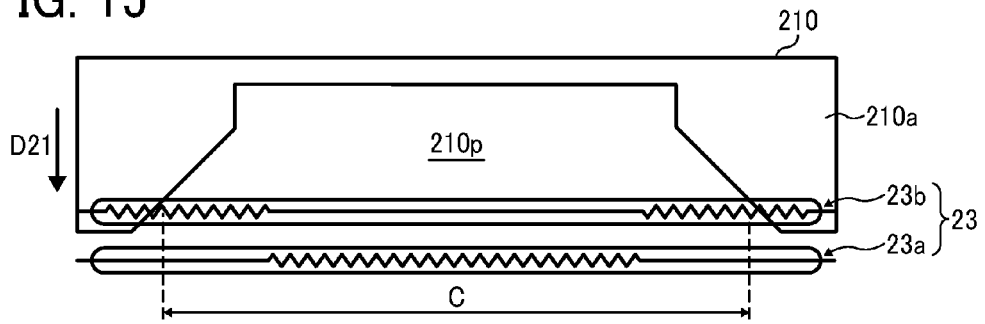
FIG. 15 is an exploded view of a shield plate and the halogen heater pair incorporated in the fixing device shown in FIG. 6 illustrating a position of the shield plate and the halogen heater pair when a sheet spanning a conveyance span C is conveyed over the fixing belt.
Figure 16:
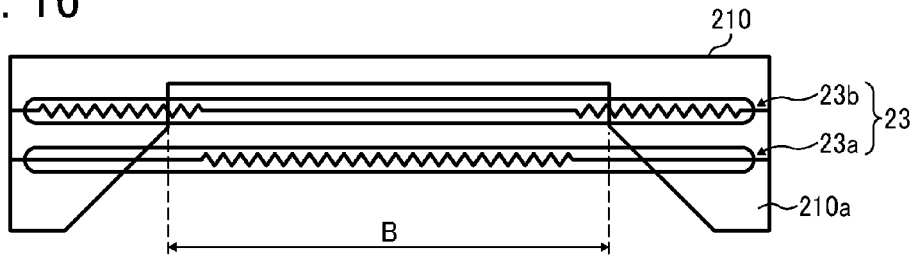
FIG. 16 is an exploded view of the shield plate and the halogen heater pair shown in FIG. 15 illustrating a position of the shield plate and the halogen heater pair when a sheet spanning a conveyance span B is conveyed over the fixing belt.
Figure 17:
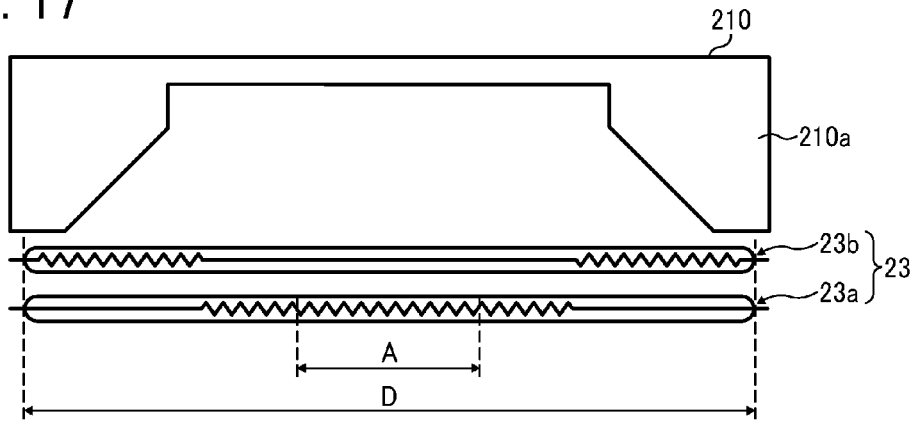
FIG. 17 is an exploded view of the shield plate and the halogen heater pair shown in FIG. 15 illustrating a position of the shield plate and the halogen heater pair when a sheet spanning a conveyance span A or D is conveyed over the fixing belt.

With reference to FIGS. 15 to 17, a description is provided of a configuration of a shield plate 210 installable in the fixing devices 20, 20S, 20T, and 20U. FIG. 15 is an exploded view of the shield plate 210 and the halogen heater pair 23 illustrating a position of the shield plate 210 and the halogen heater pair 23 when a sheet P spanning the conveyance span C is conveyed over the fixing belt 21.

FIG. 16 is an exploded view of the shield plate 210 and the halogen heater pair 23 illustrating a position of the shield plate 210 and the halogen heater pair 23 when a sheet P spanning the conveyance span B is conveyed over the fixing belt 21. FIG. 17 is an exploded view of the shield plate 210 and the halogen heater pair 23 illustrating a position of the shield plate 210 and the halogen heater pair 23 when a sheet P spanning the conveyance span A or D is conveyed over the fixing belt 21.

As described above, the equalizer 41, the absorbers 42 and 43, and the shield plate 210 attain different advantageous configurations, respectively. In order to enhance performance and attain advantages of the equalizer 41, the absorber 42 and 43, and the shield plate 210, the equalizer 41 and the shield plate 210 are installed in the fixing devices 20, 20S, 20T, and 20U. For example, the equalizer 41 suppresses overheating or temperature increase of both lateral ends of the fixing belt 21 in the axial direction thereof when a small sheet P is conveyed over the fixing belt 21. Conversely, the shield plate 210 suppresses overheating or temperature increase of both lateral ends of the fixing belt 21 in the axial direction thereof when a large sheet P is conveyed over the fixing belt 21. Accordingly, the inboard shield portion 210*b* depicted in FIG. 14 that shields the fixing belt 21 from the halogen heater pair 23 when the small sheet P is conveyed over the fixing belt 21 is not necessary. Consequently, the shield plate 210 includes the outboard shield portion 210*a* configured to shield the fixing belt 21 from the halogen heater pair 23 when the large sheet P is conveyed over the fixing belt 21 as shown in FIGS. 15 to 17 and does not include the inboard shield portion 210*b*.

The shield plate 210 shields the fixing belt 21 from the lateral end heater 23*b*. The shield plate 210 serving as a light shield is interposed between the halogen heater pair 23 and the fixing belt 21 to rotate in the rotation direction D21 of the fixing belt 21 to a plurality of shield positions and shield the fixing belt 21 from light emitted from the halogen heater pair 23 at the plurality of shield positions. The center heater 23*a* heats the center span on the fixing belt 21 in the axial direction thereof and the lateral end heater 23*b* heats both lateral end spans on the fixing belt 21 in the axial direction thereof.

The outboard shield portion 210*a* is tapered to define a width of an aperture 210*p* in an axial direction of the shield plate 210 parallel to the axial direction of the fixing belt 21 that increases gradually downward in FIG. 15 in the rotation direction D21 of the fixing belt 21. Accordingly, a light shielding rate of the shield plate 210 in the axial direction thereof parallel to a width direction of the sheet P changes as the shield plate 210 rotates. Since the light shielding rate of the shield plate 210 in the axial direction thereof changes as the shield plate 210 rotates, the shield plate 210 suppresses overheating or temperature increase of both lateral ends of the fixing belt 21 in the axial direction thereof as the sheets P of a plurality of sizes are conveyed over the fixing belt 21.

One of the plurality of heaters, that is, the lateral end heater 23*b*, that is to be screened by the shield plate 210 is disposed at a position where the shield plate 210 shields the fixing belt 21 from the lateral end heater 23*b* more readily than another heater, that is, the center heater 23*a*. In other words, one of the plurality of heaters, that is, the lateral end heater 23*b*, that is to be screened by the shield plate 210 is disposed at a position where the shield plate 210 screens the lateral end heater 23*b* more readily than another heater, that is, the center heater 23*a*. The shield plate 210 rotates downward from a standby position shown in FIG. 13A, that is, an uppermost position in the rotation direction D21 of the fixing belt 21, inside the loop formed by the fixing belt 21, so as to screen the halogen heater pair 23. Accordingly, the shield plate 210 screens the lateral end heater 23*b* disposed at an upstream position above or upstream from the center heater 23*a* in the rotation direction D21 of the fixing belt 21 more readily than the center heater 23*a* disposed at a downstream position below or downstream from the lateral end heater 23*b* where motion of the shield plate 210 is restricted in a limited space inside the loop formed by the fixing belt 21. For example, the outboard shield portion 210*a* of the shield plate 210 contacts the nip formation pad 24 depicted in FIG. 2 at the downstream position. Thus, the nip formation pad 24 restricts motion of the shield plate 210.

To address this circumstance, the lateral end heater 23*b* is disposed above or upstream from the center heater 23*a* in the rotation direction D21 of the fixing belt 21 inside the loop formed by the fixing belt 21 so that the outboard shield portion 210*a* configured to shield the non-conveyance span outboard from the conveyance span on the fixing belt 21 where the large sheet P is conveyed shields the fixing belt 21 from the lateral end heater 23*b* effectively in an increased span on the fixing belt 21 in the axial direction thereof. Such arrangement of the center heater 23*a* and the lateral end heater 23*b* is available because the shield plate 210 is requested to screen the lateral end heater 23*b* and not to screen the center heater 23*a* according to this exemplary embodiment. Since the shield plate 210 rotates within a decreased rotation angle great enough to suppress overheating or temperature increase of both lateral ends of the fixing belt 21 in the axial direction thereof, the reflector 26 depicted in FIGS. 2, 3, 6, 8, and 10 reflects light from the halogen heater pair 23 toward an increased circumferential span on the fixing belt 21, improving heating efficiency of heating the fixing belt 21. Additionally, the shield plate 210 does not move to the downstream shield position where it is difficult for the shield plate 210 to shield the fixing belt 21 from the halogen heater pair 23 precisely, increasing an irradiation angle of the halogen heater pair 23 and therefore improving heating efficiency of heating the fixing belt 21.

FIG. 15 illustrates the shield plate 210 situated at an upstream shield position slightly below and downstream from the uppermost standby position in the rotation direction D21 of the fixing belt 21 inside the loop formed by the fixing belt 21. When the shield plate 210 is situated at the upstream shield position, the outboard shield portion 210*a* of the shield plate 210 screens a part of the lateral end heater 23*b*. The lateral end heater 23*b* and the center heater 23*a* are powered on. The conveyance span C is equivalent to a width of an A3 size sheet in portrait orientation, for example.

FIG. 16 illustrates the shield plate 210 situated at a downstream shield position below and downstream from the upstream shield position shown in FIG. 15 in the rotation direction D21 of the fixing belt 21. When the shield plate 210 is situated at the downstream shield position, the outboard shield portion 210*a* of the shield plate 210 screens a part of the lateral end heater 23*b*. The downstream shield position of the shield plate 210 may define a downstream end of a motion span of the shield plate 210 that rotates in the circumferential direction of the fixing belt 21. The lateral end heater 23*b* and the center heater 23*a* are powered on. The conveyance span B is equivalent to a width of an A4 size sheet in portrait orientation, for example.

FIG. 17 illustrates the shield plate 210 situated at the uppermost standby position inside the loop formed by the fixing belt 21. When the shield plate 210 is situated at the standby position, the outboard shield portion 210*a* of the shield plate 210 does not screen the lateral end heater 23*b*. The standby position of the shield plate 210 defines an upstream end of the motion span of the shield plate 210 that rotates in the circumferential direction of the fixing belt 21. The conveyance span A is equivalent to a width of a postcard, for example. When a sheet P spanning the conveyance span A is conveyed over the fixing belt 21, the center heater 23*a* is powered on and the lateral end heater 23*b* is not powered on. The conveyance span D is equivalent to a width of an A3 extension size sheet, for example. When a sheet P spanning the conveyance span D is conveyed over the fixing belt 21, the center heater 23*a* and the lateral end heater 23*b* are powered on.

According to this exemplary embodiment, the equalizer 41 and the like suppress overheating or temperature increase of both lateral ends of the fixing belt 21 in the axial direction thereof when the small sheet P is conveyed over the fixing belt 21. Accordingly, the reflector 26 does not restrict the irradiation span of the halogen heater pair 23. For example, unlike the reflector 26 shown in FIG. 3, the reflector 26 according to this exemplary embodiment does not include a lower portion that extends along the halogen heater pair 23. Additionally, the number of reflections of light emitted from the halogen heater pair 23 and reflected by the reflector 26 decreases and thereby attenuation in the light intensity decreases, thus improving heating efficiency of heating the fixing belt 21 and saving energy.

A description is provided of a construction of a driver 250 installable in the fixing devices 20, 20S, 20T, and 20U.

Figure 18:
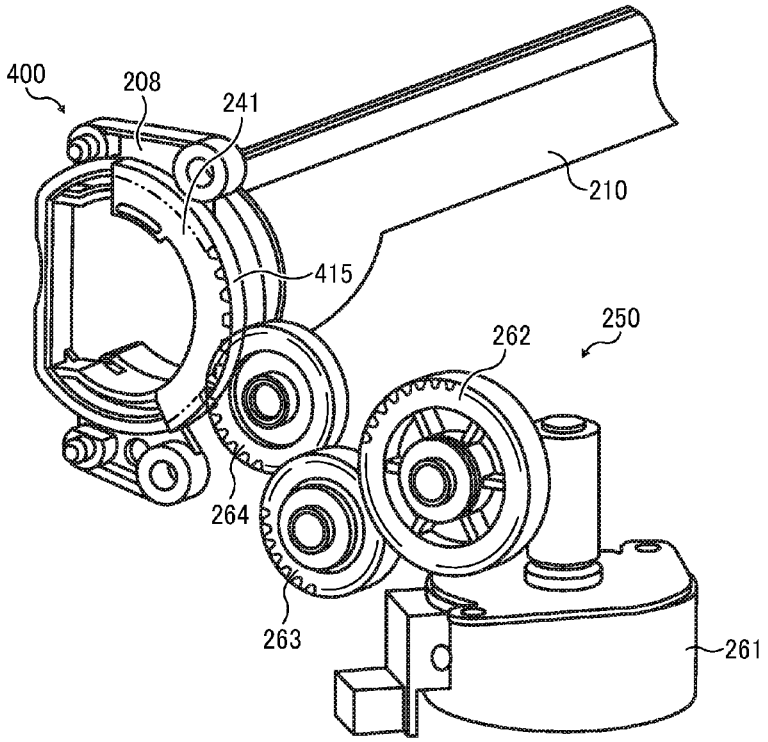
FIG. 18 is a perspective view of a driver that drives and rotates the shield plate shown in FIG. 15 forward and backward.

FIG. 18 is a perspective view of the driver 250 that drives and rotates the shield plate 210 forward and backward. As shown in FIG. 18, the driver 250 is disposed at one lateral end of the shield plate 210 in the axial direction thereof, that is, at a left end of the shield plate 210 in FIG. 18. The driver 250 includes a motor 261 serving as a driving source and a plurality of gears 262, 263, and 264 constituting a gear train. The gear 262 situated at one end of the gear train is coupled to an output shaft of the motor 261. The gear 264 situated at another end of the gear train meshes with a gear portion 415 mounted on an outer circumferential surface of a slider 241 described below in detail. As the motor 261 is driven and rotated forward and backward, a driving force generated by the motor 261 is transmitted to the slider 241 through the gear train, rotating the shield plate 210 forward and backward.

A description is provided of a construction of a support mechanism 400 that supports the fixing belt 21.

Figure 19:
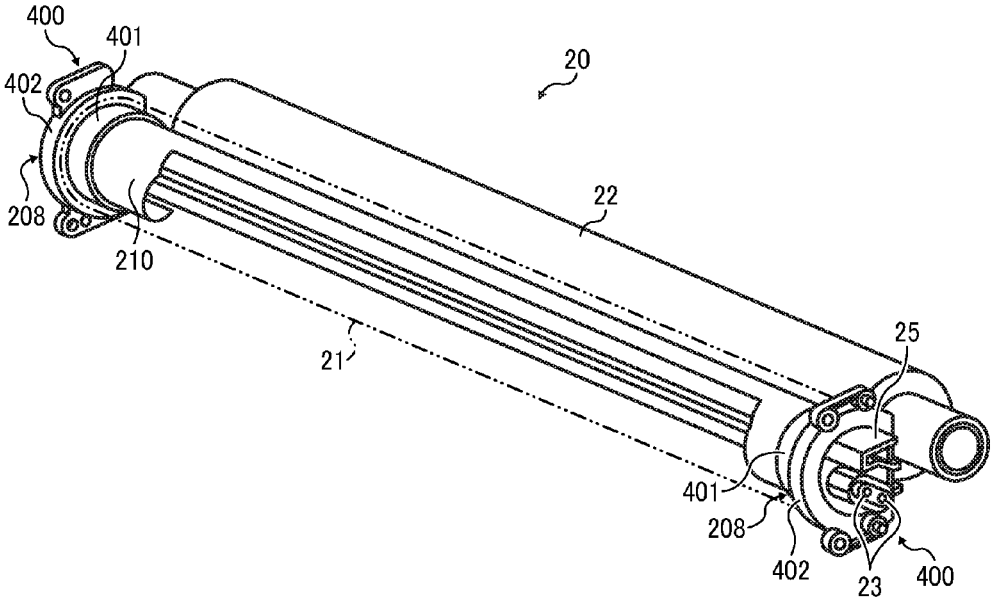
FIG. 19 is a perspective view of a support mechanism incorporated in the fixing device shown in FIG. 6.
Figure 20:
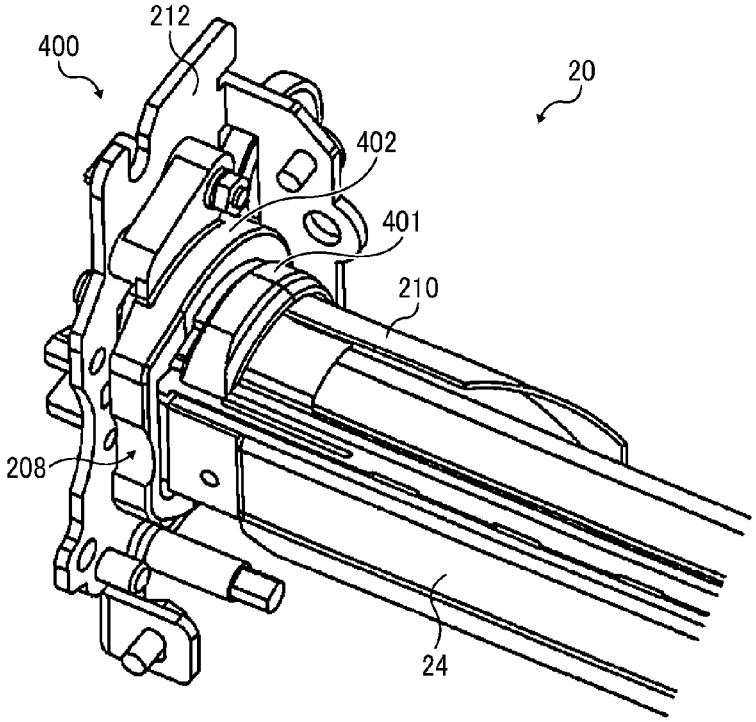
FIG. 20 is a perspective view of the support mechanism shown in FIG. 19 disposed at a right end of the shield plate shown in FIG. 19.

FIG. 19 is a perspective view of the support mechanism 400. FIG. 20 is a perspective view of the support mechanism 400 disposed at another lateral end of the shield plate 210 in the axial direction thereof, that is, at a right end of the shield plate 210 in FIG. 19, not provided with the driver 250. FIG. 20 illustrates the support mechanism 400 reversed vertically from a position of the support mechanism 400 shown in FIG. 19 and seen from the fixing nip N. It is to be noted that the axial direction, a circumferential direction, and a radial direction of the shield plate 210 described below denote directions defined by a rotation axis of the shield plate 210, respectively. For example, the axial direction of the shield plate 210 is equivalent to a longitudinal direction of the shield plate 210.

A detailed description is now given of a configuration of a pair of flanges 208 incorporated in the support mechanism 400.

As shown in FIG. 19, the flanges 208 are disposed at both lateral ends of the fixing belt 21 in the axial direction thereof, respectively. The fixing belt 21 is rotatably supported by an outer circumferential surface of each of the flanges 208. As shown in FIG. 20, the flange 208 is detachably fastened to a side plate 212 of the fixing device 20 with a screw or the like.

As shown in FIGS. 18 and 19, the shield plate 210 is rotatably supported by the support mechanism 400 including the flange 208 and the slider 241 and being disposed at each lateral end of the shield plate 210 in the axial direction thereof.

Figure 21:
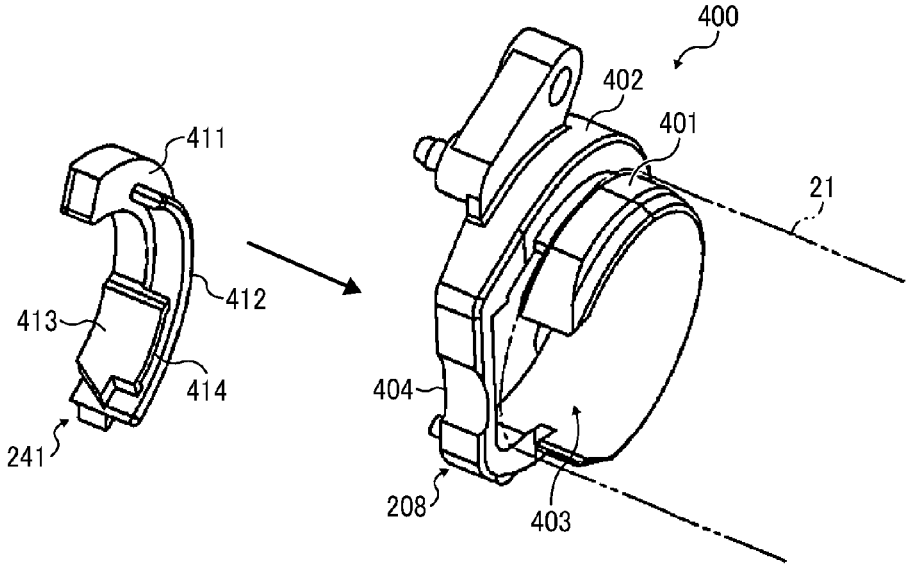
FIG. 21 is a perspective view of the support mechanism shown in FIG. 20.

FIG. 21 is a perspective view of the support mechanism 400. As shown in FIG. 21, the flange 208 is hollow and open at both lateral ends in an axial direction thereof parallel to the axial direction of the fixing belt 21. The flange 208 includes a receiver 401 extending in the axial direction of the fixing belt 21 and a flange portion 402 projecting in the radial direction of the shield plate 210 from the receiver 401 and being molded with the receiver 401. The receiver 401 includes a slit 403 at a part of the receiver 401 in the circumferential direction of the fixing belt 21 and is partially cylindrical or tubular. As shown in FIG. 20, the nip formation pad 24 is inserted into a space defined by the slit 403 depicted in FIG. 21. An end of the nip formation pad 24 in the axial direction of the fixing belt 21 is mounted on the side plate 212 and in contact with an inner circumferential surface of the flange portion 402. An end of each of the halogen heater pair 23 and the stay 25 depicted in FIG. 2 in the axial direction of the fixing belt 21 that are disposed inside the loop formed by the fixing belt 21 is also mounted on the side plate 212 and in contact with an inner circumferential surface of the receiver 401 and the flange portion 402.

As shown in FIG. 21, the slider 241 is disposed opposite the fixing belt 21 via the flange 208 in the axial direction of the fixing belt 21. For example, the slider 241 is disposed opposite the receiver 401 of the flange 208 attached with the fixing belt 21 via the flange portion 402 of the flange 208. The flange 208 further includes an opposed face 404, serving as an outer face of the flange 208, disposed opposite the slider 241 in the axial direction of the fixing belt 21. The slider 241 includes an opposed face 411, serving as an inner face of the slider 241, disposed opposite the flange 208 in the axial direction of the fixing belt 21.

Figure 22:
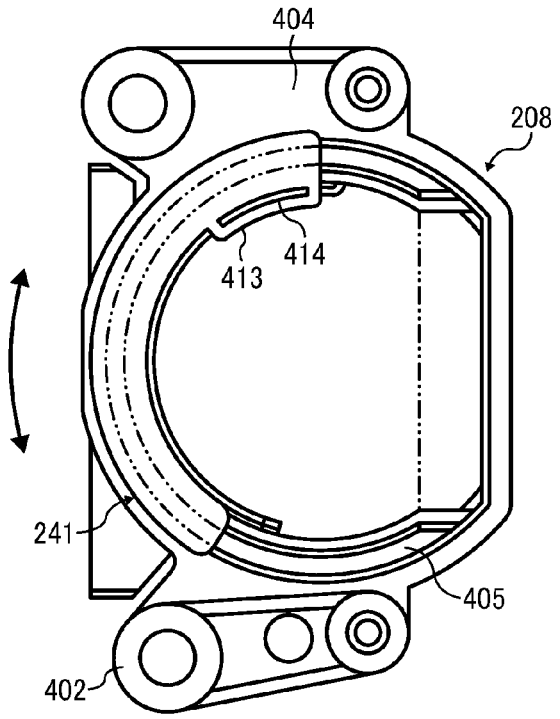
FIG. 22 is a front view of a slider attached to a flange incorporated in the support mechanism shown in FIG. 21.
Figure 23:
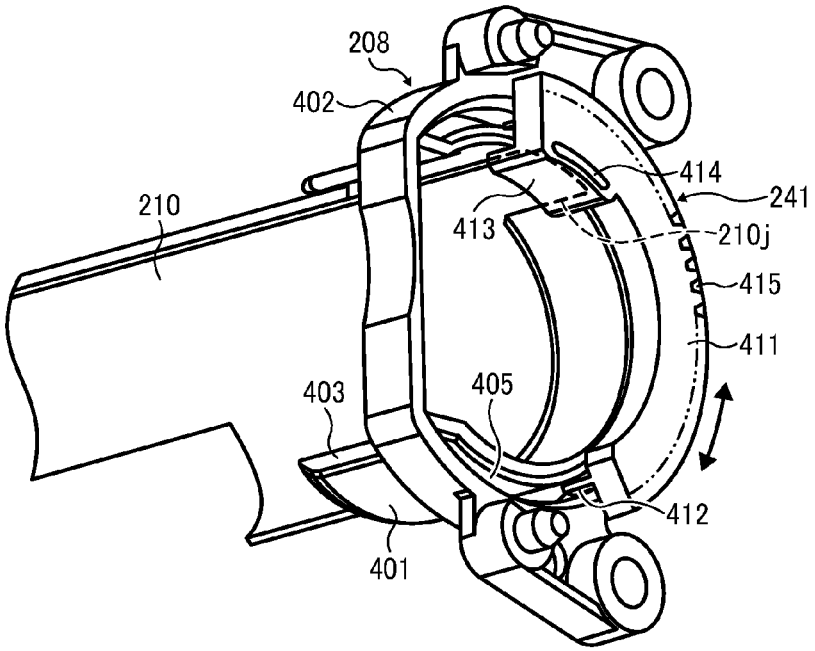
FIG. 23 is a perspective view of the flange shown in FIG. 22 that supports the shield plate shown in FIG. 18.

The slider 241 is arcuate in cross-section seen from the flange 208. The opposed face 411 of the slider 241 mounts a rib 412 serving as a male thread extending in the circumferential direction of the fixing belt 21. A bulge 413 projects from an inner circumferential surface of the slider 241. An arcuate slit 414 is contoured along an inner circumferential surface of the bulge 413 and extended along the circumferential direction of the shield plate 210. FIG. 22 is a front view of the slider 241 attached to the flange 208. FIG. 23 is a perspective view of the flange 208 supporting the shield plate 210. As shown in FIG. 23, the shield plate 210 includes a projection 210*j* projecting from each lateral end (e.g., the outboard shield portion 210*a*) of the shield plate 210 in the longitudinal direction thereof. The projection 210*j* is inserted into the slit 414. Thus, the shield plate 210 is coupled with the slider 241 such that the shield plate 210 and the slider 241 are rotatable together.

The flange 208 and the slider 241 are installed inside the fixing device 20 in a state in which the slider 241 contacts the flange 208 in the axial direction of the fixing belt 21. FIG. 22 is a front view of the slider 241 and the flange 208 installed inside the fixing device 20. As shown in FIG. 22, the opposed face 404 of the flange 208 mounts a guide groove 405 serving as a female thread extending in the circumferential direction of the fixing belt 21. As shown in FIG. 23, the rib 412 of the slider 241 engages the guide groove 405 of the flange 208. A length of the guide groove 405 is greater than a length of the rib 412 in the circumferential direction of the shield plate 210. The length of the guide groove 405 is substantially equivalent to a length of the receiver 401 in the axial direction of the shield plate 210.

Each of the flange 208 and the slider 241 is produced by injection molding with resin. Each of the flange 208 and the slider 241 is made of heat resistant resin that facilitates sliding of the slider 241 over the flange 208 such as liquid crystal polymer and polyimide. The flange 208 and the slider 241 may be made of an identical resin or a different resin. In order to reduce manufacturing costs, the flange 208 and the slider 241 are produced by injection molding with resin. Alternatively, if manufacturing costs are not considerable, one or both of the flange 208 and the slider 241 may be made of metal.

FIGS. 20 to 22 illustrate one of the support mechanisms 400 that support both lateral ends of the shield plate 210 in the axial direction thereof, respectively, that is, the support mechanism 400 not connected to the driver 250. FIGS. 20 to 22 also illustrate the flange 208 and the slider 241 incorporated in the support mechanism 400. Conversely, FIGS. 18 and 23 illustrate another one of the support mechanisms 400, that is, the support mechanism 400 connected to the driver 250 and having the construction identical to that of the support mechanism 400 not connected to the driver 250. As shown in FIG. 18, the support mechanism 400 connected to the driver 250 includes the gear portion 415 mounted on the outer circumferential surface of the slider 241 and meshed with the gear 264 of the driver 250. The gear portion 415 distinguishes the slider 241 of the support mechanism 400 connected to the driver 250 from the slider 241 of the support mechanism 400 not connected to the driver 250 and not incorporating the gear portion 415.

As described above, the equalizer 41 suppresses overheating or temperature increase of both lateral ends of the fixing belt 21 in the axial direction thereof when a small sheet P (e.g., a postcard) is conveyed over the fixing belt 21. Conversely, the shield plate 210 suppresses overheating or temperature increase of both lateral ends of the fixing belt 21 in the axial direction thereof when a large sheet P (e.g., an A3 size sheet and a DLT size sheet) is conveyed over the fixing belt 21. Thus, the shield plate 210 prevents temperature decrease of both lateral ends of the fixing belt 21 in the axial direction thereof caused by the equalizer 41 immediately after the fixing device 20 is powered on and improves productivity of the fixing device 20 when the large sheet P is conveyed therethrough. If the fixing device 20 includes the comparative shield plate 210C depicted in FIG. 14 and does not incorporate the equalizer 41, the comparative shield plate 210C is requested to shield the fixing belt 21 from the halogen heater pair 23 when the large sheet P and the small sheet P are conveyed over the fixing belt 21.

To address this request, the center heater 23*a* is disposed in proximity to the comparative shield plate 210C at the standby position and the lateral end heater 23*b* is disposed downstream from the center heater 23*a* and spaced away from the comparative shield plate 210C at the standby position further than the center heater 23*a* in the rotation direction D21 of the fixing belt 21. Conversely, the shield plate 210 according to the exemplary embodiments described above is requested to shield the fixing belt 21 from the halogen heater pair 23 when the large sheet P is conveyed over the fixing belt 21 and not requested to shield when the small sheet P is conveyed over the fixing belt 21. Accordingly, as shown in FIG. 17, the lateral end heater 23*b* is disposed in proximity to the shield plate 210 at the standby position. Consequently, the shield plate 210 screens the lateral end heater 23*b* more readily in a configuration in which the lateral end heater 23*b* is disposed upstream from the center heater 23*a* in the rotation direction D21 of the fixing belt 21 and in proximity to the shield plate 210 at the standby position than in a configuration in which the lateral end heater 23*b* is disposed downstream from the center heater 23*a* in the rotation direction D21 of the fixing belt 21 and spaced apart from the comparative shield plate 210C at the standby position as shown in FIG. 14. Thus, the halogen heater pair 23 achieves an increased irradiation angle, saving energy.

A description is provided of advantages of the fixing devices 20, 20S, 20T, and 20U.

As shown in FIGS. 2, 3, 6, 8, 10, and 15, a fixing device (e.g., the fixing devices 20, 20S, 20T, and 20U) includes a fixing rotator (e.g., the fixing belt 21) rotatable in a predetermined direction of rotation (e.g., the rotation direction D21); a pressure rotator (e.g., the pressure roller 22), rotatable in a predetermined direction of rotation (e.g., the rotation direction D22), disposed opposite the fixing rotator; a plurality of heaters (e.g., the center heater 23*a* serving as a first heater and the lateral end heater 23*b* serving as a second heater) disposed opposite an inner circumferential surface of the fixing rotator to heat the fixing rotator; a nip formation pad (e.g., the nip formation pads 24, 24T, and 24U) disposed opposite the inner circumferential surface of the fixing rotator and pressing against the pressure rotator via the fixing rotator to form the fixing nip N between the fixing rotator and the pressure rotator; and a rotatable light shield (e.g., the shield plate 210) interposed between the plurality of heaters and the fixing rotator to shield the fixing rotator from light emitted from the plurality of heaters. As a recording medium (e.g., a sheet P) bearing a toner image (e.g., a toner image T) is conveyed through the fixing nip N, the fixing rotator and the pressure rotator fix the toner image on the recording medium. The nip formation pad includes a base (e.g., the base 51) having a basic thermal conductivity and a first thermal conductor (e.g., the equalizer 41). The first thermal conductor is sandwiched between the base and the fixing rotator at the fixing nip N. The first thermal conductor has a first thermal conductivity greater than the basic thermal conductivity of the base. The light shield moves to a shield position where the light shield is interposed between the second heater and the fixing rotator to shield the fixing rotator from light emitted from the second heater. The second heater is disposed at a location where the light shield screens the second heater more readily than the first heater. For example, the second heater is disposed upstream from the first heater in the direction of rotation of the fixing rotator.

Accordingly, as recording media of decreased and increased sizes are conveyed through the fixing nip N, the fixing device suppresses overheating or temperature increase of both lateral ends of the fixing rotator in an axial direction thereof effectively without consuming energy while preventing side effects such as degradation in energy saving, extension of the warm-up time, and shortage of heat in the fixing rotator.

As shown in FIGS. 5B, 7B, 9B, and 11B, the conveyance spans A, B, C, and D where sheets P of various sizes are conveyed over the fixing belt 21 are centered in the axial direction of the fixing belt 21. Hence, the non-conveyance span on the fixing belt 21, outboard from each of the conveyance spans A, B, C, and D, where the sheets P are not conveyed over the fixing belt 21 is produced at each lateral end of the fixing belt 21 in the axial direction thereof. Alternatively, the conveyance spans A, B, C, and D may be defined along one lateral edge of the fixing belt 21 in the axial direction thereof and the non-conveyance span on the fixing belt 21 may be defined along another lateral edge of the fixing belt 21 in the axial direction thereof.

According to the exemplary embodiments described above, the fixing belt 21 serves as a fixing rotator. Alternatively, a fixing film, a fixing sleeve, or the like may be used as a fixing rotator. Further, the pressure roller 22 serves as a pressure rotator. Alternatively, a pressure belt or the like may be used as a pressure rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A fixing device comprising:

a fixing rotator rotatable in a predetermined direction of rotation;

a pressure rotator disposed opposite the fixing rotator;

a nip formation pad pressing against the pressure rotator via the fixing rotator to form a fixing nip therebetween, through which a recording medium bearing a toner image is conveyed, the nip formation pad including:

a base having a basic thermal conductivity; and a first thermal conductor sandwiched between the base and the fixing rotator at the fixing nip and having a first thermal conductivity greater than the basic thermal conductivity of the base;

a first heater disposed opposite an inner circumferential surface of the fixing rotator to heat the fixing rotator;

a second heater disposed opposite the inner circumferential surface of the fixing rotator to heat the fixing rotator;

a rotatable light shield to move to a shield position where the light shield is interposed between the second heater and the fixing rotator to shield the fixing rotator from light emitted from the second heater, the second heater being disposed at a location where the light shield screens the second heater more readily than the first heater;

a flange to rotatably support the fixing rotator;

a slider attached to the flange and including:

a slit extending in the direction of rotation of the fixing rotator; and a gear portion mounted on an outer circumferential surface of the slider; and a driver including a gear to mesh with the gear portion of the slider to drive and rotate the slider;

wherein the light shield includes a projection projecting in an axial direction of the fixing rotator and being inserted into the slit of the slider.

2. The fixing device according to claim 1, wherein the second heater is disposed upstream from the first heater in the direction of rotation of the fixing rotator.

3. The fixing device according to claim 2, wherein the first heater and the second heater are disposed upstream from the nip formation pad in the direction of rotation of the fixing rotator.

4. The fixing device according to claim 1, wherein the first heater is disposed opposite a center span on the fixing rotator in the axial direction thereof and the second heater is disposed opposite each lateral end span on the fixing rotator in the axial direction thereof.

5. The fixing device according to claim 4, wherein the recording medium having a decreased width in the axial direction of the fixing rotator is conveyed over the center span on the fixing rotator and the recording medium having an increased width in the axial direction of the fixing rotator is conveyed over the center span and each lateral end span on the fixing rotator.

6. The fixing device according to claim 1, wherein the light shield includes a shield portion disposed outboard from a conveyance span on the fixing rotator where the recording medium having an increased width in the axial direction of the fixing rotator is conveyed over the fixing rotator.

7. The fixing device according to claim 6, wherein the shield portion is tapered to change a light shielding rate of the light shield in the axial direction of the fixing rotator as the light shield rotates.

8. The fixing device according to claim 7, wherein the shield portion is tapered to define a width of an aperture in the axial direction of the fixing rotator that increases gradually in the direction of rotation of the fixing rotator.

9. The fixing device according to claim 6, wherein the shield portion is disposed opposite a part of the second heater in the axial direction of the fixing rotator.

10. The fixing device according to claim 6, wherein the shield portion is disposed upstream from the second heater and the first heater in the direction of rotation of the fixing rotator when the recording medium having the increased width in the axial direction of the fixing rotator is conveyed over the fixing rotator.

11. The fixing device according to claim 6, wherein the shield portion screens the second heater when the recording medium having a decreased width in the axial direction of the fixing rotator is conveyed over the fixing rotator.

12. The fixing device according to claim 1, wherein the first thermal conductor extends throughout an entire span outboard from a decreased conveyance span on the fixing rotator where the recording medium having a decreased width in the axial direction of the fixing rotator is conveyed.

13. The fixing device according to claim 1, wherein the nip formation pad further includes a second thermal conductor having a second thermal conductivity greater than the basic thermal conductivity of the base, wherein the second thermal conductor is disposed opposite a part of the fixing rotator in an axial direction thereof, and wherein the second thermal conductor is disposed opposite the fixing nip via the first thermal conductor.

14. The fixing device according to claim 13, wherein the nip formation pad further includes a third thermal conductor having a third thermal conductivity greater than the basic thermal conductivity of the base and contacting the second thermal conductor.

15. The fixing device according to claim 14, wherein the first thermal conductor, the second thermal conductor, and the third thermal conductor are made of metal.

16. The fixing device according to claim 13, wherein the nip formation pad further includes a resin layer sandwiched between the first thermal conductor and the second thermal conductor.

17. The fixing device according to claim 1, wherein the flange includes a guide groove extending in the direction of rotation of the fixing rotator, and wherein the slider further includes a rib to engage the guide groove of the flange to cause the slider to slide over the flange.

18. The fixing device according to claim 1, wherein the fixing rotator includes a fixing belt and the pressure rotator includes a pressure roller.

19. An image forming apparatus comprising:

an image forming device to form a toner image; and a fixing device disposed downstream from the image forming device in a recording medium conveyance direction to fix the toner image on a recording medium, the fixing device including:

a fixing rotator rotatable in a predetermined direction of rotation;

a pressure rotator disposed opposite the fixing rotator;

a nip formation pad pressing against the pressure rotator via the fixing rotator to form a fixing nip therebetween, through which the recording medium bearing the toner image is conveyed, the nip formation pad including:

a base having a basic thermal conductivity; and a first thermal conductor sandwiched between the base and the fixing rotator at the fixing nip and having a first thermal conductivity greater than the basic thermal conductivity of the base;

a first heater disposed opposite an inner circumferential surface of the fixing rotator to heat the fixing rotator;

a second heater disposed opposite the inner circumferential surface of the fixing rotator to heat the fixing rotator; and a rotatable light shield to move to a shield position where the light shield is interposed between the second heater and the fixing rotator to shield the fixing rotator from light emitted from the second heater, the second heater being disposed at a location where the light shield screens the second heater more readily than the first heater;

a flange to rotatable support the fixing rotator;

a slider attached to the flange and including:

a slit extending in the direction of rotation of the fixing rotator; and a gear portion mounted on an outer circumferential surface of the slider; and a driver including a gear to mesh with the gear portion of the slider to drive and rotate the slider;

wherein the light shield includes a projection projecting in an axial direction of the fixing rotator and being inserted into the slit of the slider.

* * * * *